US005301594A

United States Patent [19]

Argazzi et al.

[11] Patent Number: 5,301,594

[45] Date of Patent: Apr. 12, 1994

[54] APPARATUS AND METHOD FOR EFFECTING PENETRATION AND MASS TRANSFER AT A PENETRABLE SITUS

[75] Inventors: Dennis J. Argazzi, Centerbrook; Larry A. Nativi, Rocky Hill, both of Conn.

[73] Assignee: Loctite Corporation, Hartford, Conn.

[21] Appl. No.: 998,487

[22] Filed: Dec. 30, 1992

[51] Int. Cl.[5] ..... F42B 33/00

[52] U.S. Cl. ..... 86/50; 408/56; 408/61; 141/19

[58] Field of Search ..... 86/50; 408/56, 61; 141/19; 29/DIG. 54, DIG. 64

[56] References Cited

U.S. PATENT DOCUMENTS

| | | | |
|---|---|---|---|
| 2,404,441 | 7/1946 | Hopkins | 86/50 |
| 3,672,942 | 6/1972 | Neumann et al. | 117/62.2 |
| 3,909,388 | 9/1975 | Faust et al. | 86/50 |
| 4,046,055 | 9/1977 | McDanolds et al. | 86/50 |
| 4,555,047 | 11/1985 | Ackley | 408/56 |
| 5,195,588 | 3/1993 | Dave | 166/255 |

*Primary Examiner*—J. Woodrow Eldred
*Attorney, Agent, or Firm*—Steven J. Hultquist

[57] ABSTRACT

An apparatus for effecting penetration and mass transfer at a penetrable situs, comprising: (a) a penetration member constructed and arranged for movement between (i) a first position disengaged from the penetrable situs, and (ii) a second position engaged with the penetrable situs to form a penetration opening in the penetrable situs communicating with an interior region thereof; (b) a motive driver for selectively moving the penetration member between the first position and second position; and (c) a mass transfer assembly (i) selectively engageable with the penetration opening in the penetrable situs, after formation thereof by the penetration member in the second position and subsequent movement of the penetration member by the motive driver to the first position, and (ii) constructed and arranged to effect mass transfer through the penetration opening between the interior region of the penetrable situs and a locus exterior to the penetrable situs, when the mass transfer assembly is engaged with the penetration opening. Also disclosed is an appertaining method of effecting penetration and mass transfer at a penetrable situs. The invention may be usefully employed for inerting of "dud" ordnance, for sampling of contained materials of unknown identity and origin having potentially hazardous character, and for other applications involving mass transfer between an interior region of a penetrable situs and a mass transfer locus exterior thereto.

24 Claims, 13 Drawing Sheets

APPARATUS AND METHOD FOR EFFECTING PENETRATION AND MASS TRANSFER AT A PENETRABLE SITUS

BACKGROUND OF THE INVENTION

1. Field of the Invention

This invention relates generally to an apparatus and method for effecting penetration of and mass transfer at a penetrable situs. In a specific and one preferred embodiment, the invention relates to apparatus and method for drilling into the interior volume of a "live" or "misfired" ordnance device and injecting into the interior volume of the live ordnance an "inerting medium" such as a rapidly solidifiable flowable composition which encapsulates and precludes operation of the firing/detonation mechanism of the ordnance.

2. Description of the Related Art

In the field of military ordnance, there exist a variety of ordnance devices, including artillery shells, launcher-as well as shoulder tube-fired rockets, grenades, mines, bombs, missiles, and other explosive weapons devices.

These ordnance devices typically incorporate an explosive "load" or "charge" (which may be a single-component explosive composition or charge, or which alternatively may be in the form of two or more explosive co-reactants, in the case of binary or multicomponent explosive systems), together with a firing or detonation mechanism, referred to hereafter as the "actuation mechanism," which may for example include a blasting cap, time-delay fuse, firing pin, impact ignition device, stab action element, timer, pressure-sensitive electrical resistance heating element, or other subassembly or structure which functions to ignite or detonate the explosive charge.

It is a not infrequent occurrence that the explosive ordnance article when deployed does not explode, due to the failure or malfunction of the actuation mechanism. As a result, the live ordnance article remains in a potentially explosive condition, and may be subject to detonation if the ordnance is impacted, moved, or operated on by an ordnance technician for the purpose of "disarming" the device, and may also be detonated by passage of time, such as may occur in the case of a faulty timer.

In military ordnance parlance, these potentially explosive misfiring ordnance devices are known as "duds," and they pose a self-evident and potentially severe risk of injury or death to persons encountering same. Examples range from explosive cannonballs of 18th and 19th century warfare which may remain buried in battlefields of that era, to misfired cruise missiles and armor-piercing artillery shells of the present time.

In addition to misfired ordnance devices which remain in a latent explosive state, other ordnance devices, e.g., land and sea mines, may be armed and deployed in a battle area, and subsequently may be abandoned upon retreat, forward movement of troop forces, or cessation of hostilities. In addition, mines, bombs, or trippable grenades may be deployed in civilian areas by guerrilla or terrorist personnel.

Upon discovery, these duds or otherwise deployed and unexploded ordnance devices may require the efforts of demolition's or ordnance experts to disable them. Such efforts are frequently very hazardous, and there are numerous instances in which "bomb squad," ordnance, or munitions personnel have been killed or seriously injured when an explosive device prematurely exploded during efforts to disarm it.

As an example of the prior art practice of the "inerting" of artillery shell or mortar round duds, it has been conventional practice for American military forces to dispatch an ordnance technician with a power drill and a wet mixture of plaster of paris to the site of a dud where the explosive device by virtue of its position, e.g., near personnel, vehicles, or buildings, cannot simply be detonated by another explosive device or charge being placed nearby and exploded to in turn "set off" the dud, or where the ordnance cannot be safely exploded, such as where the explosive device contains chemical warfare agents, or where the ordnance must be inerted to bring it back intact from the area of deployment, to show usage of ordnance by the opposing military or guerrilla/terrorist forces, which is banned by treaty or agreement. The ordnance technician would then drill into the fuse or actuation mechanism portion of the device (through the shell casing) and pump the wet plaster of paris mixture into the interior volume of the casing containing the actuation mechanism. In this manner, the injected plaster of paris mixture would flow around and encapsulate the actuation mechanism, progressively hardening so that upon final curing the actuation mechanism would be "frozen" or physically precluded from operation, so that the dud could be safely handled and subsequently disposed of in a non-hazardous manner.

The above-described prior art practice of inerting ordnance duds entails obvious danger and risks. In the drilling operation, the mere vibration or torque-induced translation of the dud caused by the drilling may be sufficient to cause a faulty actuation mechanism to become unstuck or otherwise effect ignition of the explosive charge. In addition, where exotic or custom ordnance are involved, or even ordnance previously unencountered by the personnel responsible for disarming the device, the specific location of the actuation mechanism may not be known or ascertainable, and in such instances drilling may also cause detonation of the explosive or otherwise fail to properly inert the ordnance article.

It would therefore be a substantial advance in the art of munitions and ordnance technology to provide a means and method for inerting of duds and other desirably inactivated live explosive devices, which minimize the risk of harm to demolitions and ordnance personnel involved in the inerting of such explosives and devices, as well as to the surrounding environment in proximity to the dud or live explosive device to be inerted.

In addition to ordnance inerting applications, many other applications exist in which it is desired to penetrate a penetrable situs and effect mass transfer therewith. Examples include: sampling of containers of unknown contents, in which toxic or otherwise hazardous materials may be present, e.g., waste drums of unknown origin and contents, at landfills, waste dumps, and abandoned industrial sites; collection of subsurface samples in terrestrial or extraterrestrial exploration; testing of gas for breathability in subterranean passages; injection of plastique or other detonatable explosive materials into bored openings in rock formations; injection of poison gas into underground bunkers during warfare; and underwater rescue involving injection of oxygen or oxygen-containing gas into the crew compartments of disabled submarines on the ocean floor. Many such penetration/mass transfer operations are desirably carried out from a command/control center remote from the penetrable situs.

Accordingly, it is an object of the present invention to provide a means and method for effecting penetration of and mass transfer with a penetrable situs in a simple, reliable, and efficient manner.

It is another object of the present invention to provide a means and method of such type which is of a compact and unitary configuration.

It is a still further object of the invention to provide a means and method of such type in which the penetration/mass transfer system is remotely actuatable.

Other objects and advantages of the invention will be more fully apparent from the ensuing disclosure and appended claims.

SUMMARY OF THE INVENTION

In a broad apparatus aspect, the present invention relates to an apparatus for effecting penetration and mass transfer at a penetrable situs, comprising:

(a) a penetration member constructed and arranged for movement between (i) a first position disengaged from the penetrable situs, and (ii) a second position engaged with the penetrable situs to form a penetration opening in the penetrable situs communicating with an interior region thereof;

(b) a motive driver for selectively moving the penetration member between the first position and second position; and (c) a mass transfer assembly (i) selectively engageable with the penetration opening in the penetrable situs, after formation thereof by the penetration member in the second position and subsequent movement of the penetration member by the motive driver to the first position, and (ii) constructed and arranged to effect mass transfer through the penetration opening between the interior region of the penetrable situs and a locus exterior to the penetrable situs, when the mass transfer assembly is engaged with the penetration opening.

In another, specific apparatus aspect, the present invention relates to an apparatus for effecting penetration and mass transfer at a penetrable situs, comprising:

(a) a base support;

(b) a reciprocatable penetration member mounted on the base support for reciprocatable movement thereon between (i) a first retracted position disengaged from the penetrable situs when the base support is in penetration and mass transfer proximity to the penetrable situs, and (ii) a second extended position engaged with the penetrable situs to form a penetration opening in the penetrable situs communicating with an interior region thereof, when the base support is in penetration and mass transfer proximity to the penetrable situs;

(c) a motive driver for selectively moving the reciprocatable penetration member between the first retracted position and second engaged position;

(d) a mass transfer assembly (i) mounted on the base support (ii) selectively engageable with the penetration opening in the penetrable situs, after formation thereof by the penetration member in the second extended position and subsequent movement of the penetration member by the motive driver to the first retracted position, and (iii) constructed and arranged to effect mass transfer through the penetration opening between the interior region of the penetrable situs and a locus exterior to the penetrable situs, when the mass transfer assembly is engaged with the penetration opening.

In the apparatus described above, the penetration member may suitably comprise a member selected from the group consisting of: rotary drills; impact piercing elements; lasing devices, continuous belt shovels; and saws.

In one preferred aspect, the mass transfer assembly in the apparatus broadly described above may advantageously comprise an injector assembly for injecting a flowable medium through the penetration opening into the interior region of the penetrable situs. The injector assembly in such embodiment may include: an injector carriage comprising a housing defining a flow passage therewithin; an injector nozzle mounted on the injector carriage housing and in flow communication with the flow passage therewithin; an inlet port in the injector carriage housing, coupleable with a supply container of the flowable medium; and motive drive means for selectively moving the injector carriage between (i) a first retracted position wherein the injector nozzle is non-engageable with the penetration opening of the penetrable situs, and (ii) a second engagement position wherein the injector nozzle is oriented for translational engagement with the penetration opening of the penetrable situs.

In the apparatus embodiment described in the preceding paragraph, the oriented injector nozzle in its second engagement position may be aligned with the penetration member in its first retracted position, and the motive driver (c) may be constructed and arranged to (I) forwardly translate the aligned nozzle and the retracted penetration member, as a unitary structure, toward the penetrable situs until the injector nozzle is brought into engagement with the penetration opening of the penetrable situs, and (II) rearwardly translate the aligned nozzle and the retracted penetration member, as a unitary structure, to a rearward position at which the injector nozzle is disengaged from the penetration opening of the penetrable situs.

In another preferred aspect of the invention described hereinabove, the base support described above may be constructed to comprise: a base plate resposable on a support surface and having an upper main surface; a mounting bracket positionable on the base plate and having an opening therethrough; an elongate base column having first and second ends, with the first end being of enlarged size relative to the remaining structure of the elongate base column, and with the first end being of sufficient size to be reposable in the mounting bracket opening, such that the elongate base column extends upwardly to its second end and is selectively pivotally moveable about the first end when the first end is reposed in the mounting bracket opening; and a clamping assembly for securing the mounting bracket to the base plate and for selectively securing the elongate base column in a predetermined upwardly extending orientation in relation to the base plate. In this arrangement, the penetration member, motive driver, and mass transfer assembly are advantageously structurally consolidated as a unitary penetration/mass transfer module which is selectively engageable with the elongate base column for mounting of the penetration/mass transfer module on the base support.

Thus, the apparatus of the invention may be constructed so that the mass transfer assembly comprises an injector, for delivering a predetermined material to the interior region of the penetrable situs. Alternatively, the mass transfer assembly may comprise an extractor, for withdrawing a material from the interior region of the penetrable situs.

The motive driver of the apparatus may usefully comprise electric drive means, and an electric power source therefor, or alternatively, hydraulic drive means, and a hydraulic power source therefor.

In a specific embodiment, the base support may comprise a motively driven carriage which is remotely actuatable, to translate the apparatus from a remote location into penetration and mass transfer proximity to the penetrable situs.

In a method aspect, the present invention contemplates the deployment of a penetration/mass transfer apparatus of the type broadly described hereinabove, in operational proximity to the penetrable situs, either as directly deployed in the first instance, or as remotely and controllably directed into such operational proximity when the penetration/mass transfer apparatus is configured as a motive, remotely controllable unitary device, followed by penetration of the penetrable situs to form a penetration opening therein communicating with an interior region of the situs, and mass transfer coupling of the apparatus with the penetration opening involving subsequent mass transfer between the interior region of the penetrated situs, and a mass transfer locus exterior to the penetrated situs.

In a particularly preferred aspect of the apparatus and method of the present invention, the invention is adapted for inerting of ordnance, with the penetration means serving to penetrate the casing or housing of an ordnance article, as by drilling through same, and the mass transfer means serving to inject into the interior volume of the penetrated ordnance article a flowable and solidifiable medium, such as a rapidly curable resin composition, so that after its injection, the flowable and solidifiable medium solidifies to a hardened solid state, whereby the actuation mechanism of the ordnance article is disablingly encapsulated by the solidified medium, permitting subsequent safe handling and disposition of a live ordnance article.

Other aspects and features of the invention will be more fully apparent from the ensuing disclosure and appended claims hereof.

DETAILED DESCRIPTION OF THE INVENTION AND PREFERRED EMBODIMENTS THEREOF

In the broad practice of the invention, the penetrable situs which is penetrated and subsequently subjected to mass exchange, between an interior region of the penetrable situs and a region or locus exterior of such situs, may comprise any suitable article, structure, body, or formation which is penetrable by the selected penetration means and method, and which is resultingly capable of sustaining such mass exchange. Examples of illustrative penetrable sites include ordnance devices, containers, housings, building structures, terrestrial as well as extraterrestrial land and geological formations, and vehicles and other motive structures.

The mass transfer operation involved in the practice of the invention may be any suitable passing, translation, or communication of mass from a first mass transfer site to a second mass transfer site, wherein one of such sites is within the penetrable (penetrated) situs and the other is exterior to the penetrable (penetrated) situs, and wherein the penetration opening of the situs formed by the penetration is employed as a mass flow passage in the mass transfer operation. The direction of mass exchange may be into the penetrated situs, involving introduction or injection of material thereinto, or alternatively, the direction of mass exchange may be out of the penetrated situs, involving extraction or withdrawal of material from the penetrated situs.

Specific illustrative examples of penetration/mass transfer applications of the invention include those mentioned earlier herein, viz., inerting of duds and other desirably inactivated live explosive devices, in such manner as to minimize the risk of harm to demolitions and ordnance personnel involved in the inerting of such explosives and devices, as well as to the surrounding environment in proximity to the dud or live explosive device to be inerted; sampling of containers of unknown contents, in which toxic or otherwise hazardous materials may be present, e.g., waste drums of unknown origin and contents, at landfills, waste dumps, and abandoned industrial sites; collection of subsurface samples in terrestrial or extraterrestrial exploration; testing of gas for breathability in subterranean passages; injection of plastique or other detonatable explosive materials into bored openings in rock formations; injection of poison gas into underground bunkers during warfare; and underwater rescue involving injection of oxygen or oxygen-containing gas into the crew compartments of disabled submarines on the ocean floor.

Figure 1:
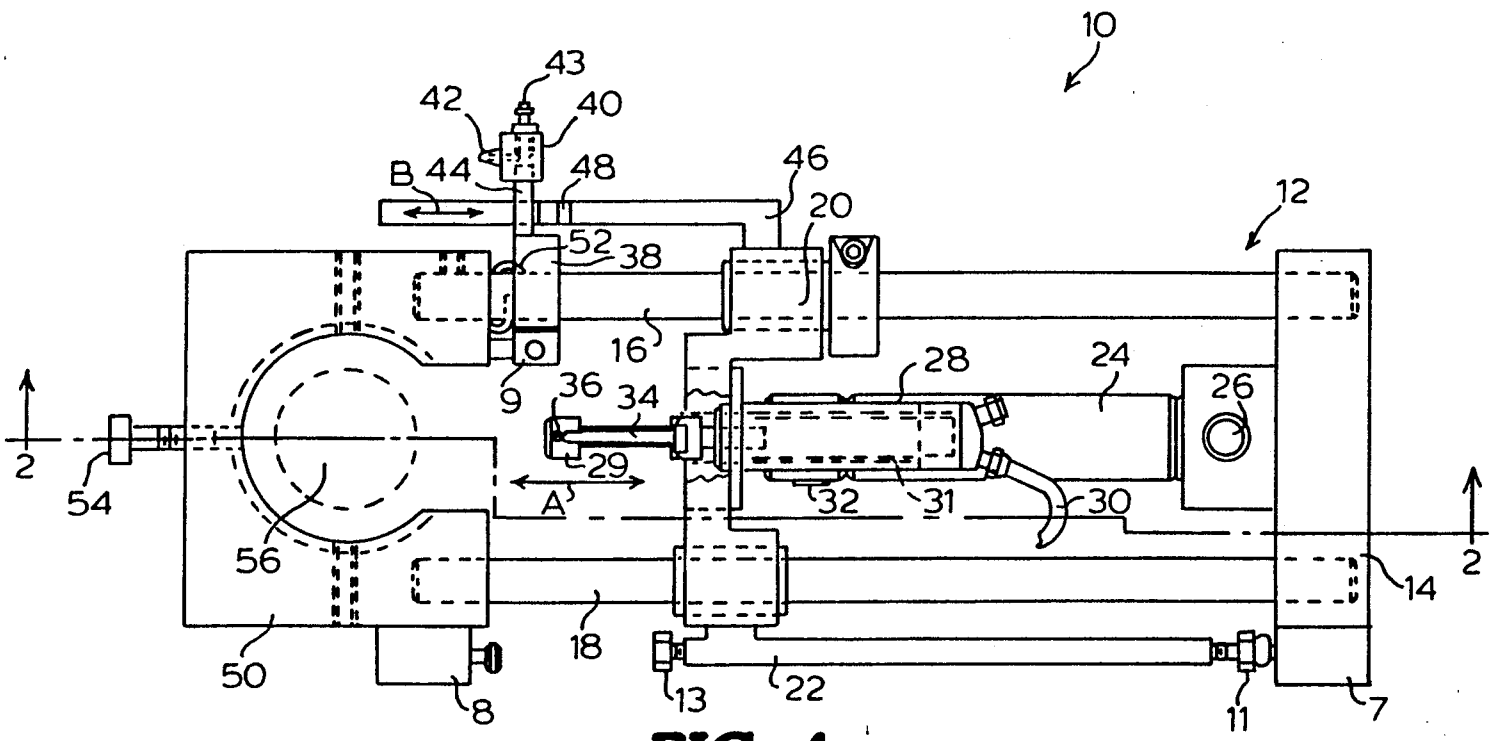
FIG. 1 is a side elevation view of a penetration/mass transfer assembly according to one embodiment of the present invention.
Figure 2:
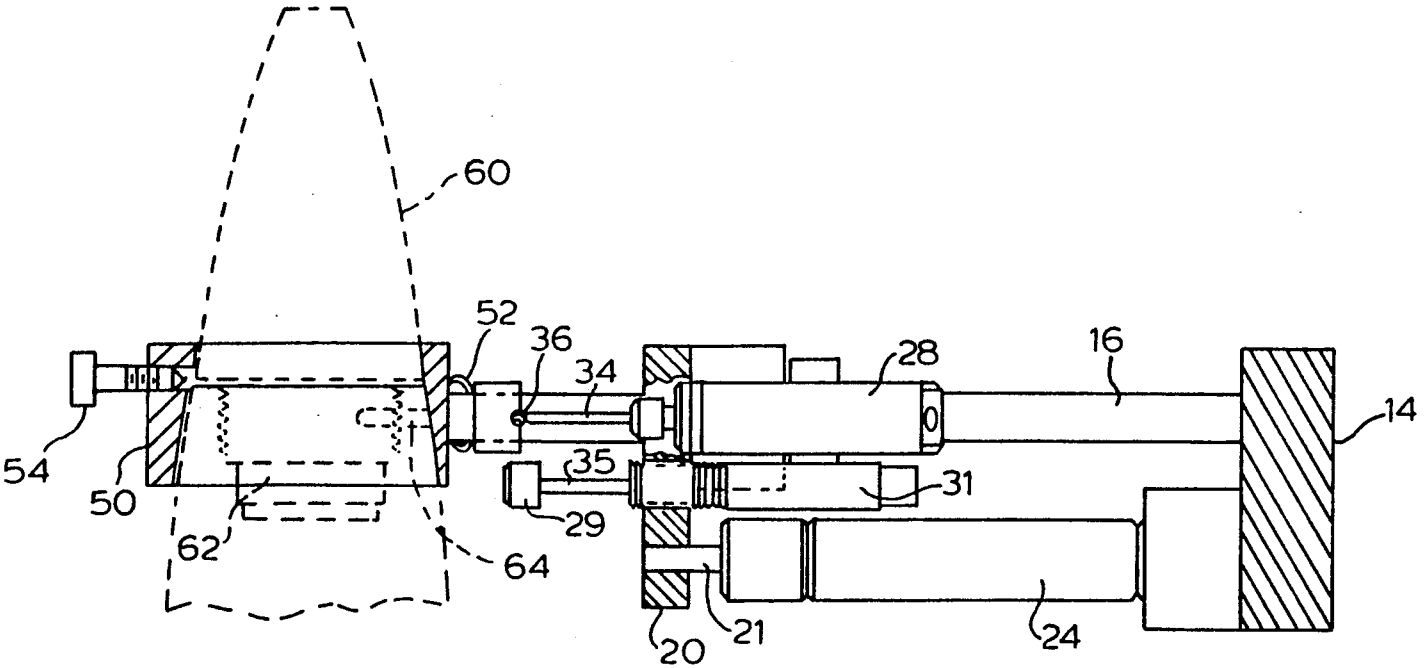
FIG. 2 is a top plan sectional view of the FIG. 1 assembly, taken along line 2—2 of FIG. 1.

Referring now to the drawings, FIG. 1 is a side elevation view of a penetration/mass transfer assembly 10 according to one embodiment of the present invention, and FIG. 2 a corresponding top plan view along line 2—2 of FIG. 1.

The apparatus 10 includes a base support structure 12 including transverse bottom member 14 in which respective openings are provided wherein guide rails 16 and 18 are journaled and suitably secured, as for example by complementary threadings in the journal openings and the exterior surfaces of the guide rails, or by mechanical fasteners, or by welding, brazing, or other suitable affixation means and/or method.

Slidably mounted on guide rails 16 and 18 is a transverse carriage member 20, which is provided with transversely spaced-apart openings therein accommodating passage therethrough of the respective guide rail element associated therewith. The openings in the transverse carriage member may be interiorly provided with bushing or other structure facilitating smooth and ready translation of the transverse carriage member along the length of the guide rails.

The transverse carriage member 20 is motively propelled forwardly or rearwardly in relation to the transverse bottom member 14 by means of the sliding cylinder 24, which is secured at a rear end to the transverse bottom member, the associated end portion of the sliding cylinder including an advancement port 26 by means of which pressurized air may be introduced into the sliding cylinder to forwardly advance the cylinder rod 21, and with the cylinder rod 21 at its front end being secured to the transverse carriage member so that when advanced, the cylinder rod effects corresponding forward translation of the transverse carriage member 20.

Also mounted on the base support structure comprising transverse bottom member 14, guide rails 16 and 18, and transverse carriage member 20, is an air drill 28 which is pneumatically actuatable by compressed air from a suitable source means (not shown) such as an air compressor or a tank of compressed air, with the compressed air being introduced to the pneumatic drill by means of compressed gas feed hose 30 coupled with the proximal end of the drill.

The drill 28 features a drill shaft 34 extending forwardly from the distal end of the drill, and having a drilling element 36 at its forward extremity. A wide variety of drill bits are commercially available comprising a drill shaft and distal drilling element, which may be potentially usefully employed in the broad practice of the invention to penetrate the specific penetrable situs which is presented.

A hydraulic speed regulator (hydraulic checking cylinder) 31 is also secured to the transverse carriage member 20 as shown. The speed regulator features a shaft 35 extending forwardly therefrom and terminating in a shock absorber 29.

The slide cylinder 24 also features a retraction port 32 by means of which compressed gas can be passed into the cylinder to effect retraction of shaft 21 and transverse carriage member 20. Slidably mounted on the guide rail 16, forwardly of transverse carriage member 20, is an injector head mounting block 38.

An ordnance mounting fixture 50 is arranged with the distal ends of the guide rails 16 and 18 positioned in corresponding openings in the ordnance mounting fixture, and secured therein by suitable set screws or other securement means (not shown). The ordnance mounting fixture 50 has associated therewith a limit valve 9, arranged as shown.

Between the injector head mounting block 38 and the mounting fixture 50, and about the guide rail 16, is disposed a head rotation spring 52.

Extending outwardly from the injector head mounting block 38 is injector head arm 44 which connects at its outer end to the injector head 40 featuring injector nozzle 42. At its outer extremity, the injector head 40 comprises a connection fitting 43, by means of which the injector head can be coupled to a source of inerting medium, e.g., a reservoir of quickly curing sealant material which rapidly solidifies in the absence of oxygen, such as an acrylic anaerobic sealant composition (reservoir not shown in FIGS. 1 and 2). A retaining bar 46 extends from the upper end of the transverse carriage member and features a detent groove 48. The retaining bar 46 is provided to impede the relative rotation of the injector head 40 about guide rail 16, as caused or induced by head rotation spring 52 in the operation of assembly 10.

Joined to the lower end of transverse carriage member 20 is a stroke limiter member 22 having stroke limiter adjustment screws 11 and 13 threadably and adjustably mounted at its respective ends, in complementarily threaded openings (not shown) in the respective end portions of the stroke limiter member 22. When the transverse carriage member 20 is in a fully retracted position as is shown in FIG. 1, the stroke limiter adjustment screw 11 mounted on the stroke limiter member 22 is contactingly engaged with a limit valve 7 mounted on transverse bottom member 14. Conversely, when the transverse carriage member 20 is in a fully advanced (fully forwardly extended) position, the stroke limiter adjustment screw 13 on stroke limiter member 22 is contactingly engaged with a limit valve 8 mounted on the lower end of ordnance mounting fixture 50. By this arrangement, the permitted travel (forward and rearward translation) of the transverse carriage member 20 and associated assembly elements, in both (forward and rearward) directions can be selectively fixed by appropriate adjustment (clockwise or counter-clockwise rotation) of the corresponding stroke limiter adjustment screws 11 and/or 13.

The ordnance mounting fixture 50 as shown in FIG. 1 has a squared-off horseshoe shape defining an interior ordnance opening 56 communicating with a transverse entrance opening allowing access by the drill tip element 36 to an ordnance article positioned in the ordnance mounting fixture, when the drill shaft 34 is extended upon actuation of the drill 28.

FIG. 2 is a top plan view of the penetration/mass transfer apparatus of FIG. 1, showing a portion of an ordnance article (illustrated in broken line representation) mounted in the ordnance mounting fixture 50, with adapter screw 54 serving to lock the ordnance article in position in the fixture. Ordnance article 60 features an actuation mechanism 62 therein, and the penetration opening to be formed in the actuation mechanism upon drilling of the ordnance article is reflected by the broken line representation of the distal portion of the drill (comprising the drill tip element 36 and the forward portion of the drill shaft 34), at the drill's most forwardly extended position, penetrating the ordnance article.

Figure 3:
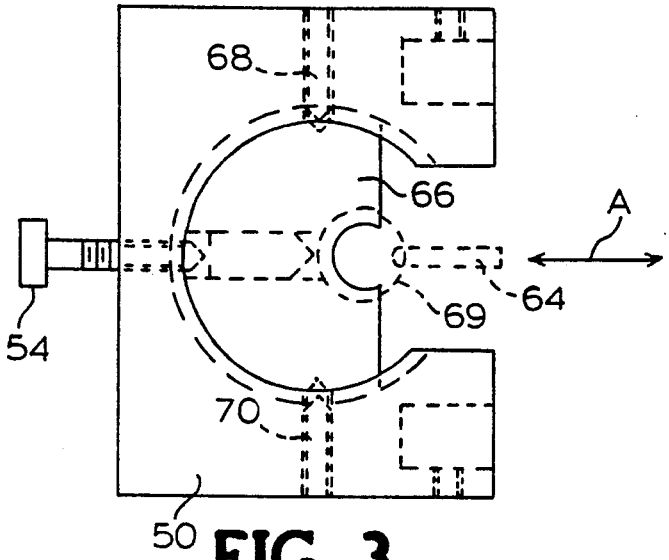
FIG. 3 is a side elevation view of the ordnance article mounting fixture shown in FIG. 1.

FIG. 3 is a front elevation view of the ordnance mounting fixture 50 of FIGS. 1 and 2, but with the modification feature of a 20-millimeter shell adapter 66 present in the central opening of the mounting fixture, and retained in position by the adapter screw 54 and the set screws 68 and 70. A 20-millimeter shell 69 is shown in broken line representation, and the penetration opening to be formed in the actuation mechanism upon drilling of the 20-millimeter shell is reflected by the broken line representation of the distal portion of the drill (comprising the drill tip element 36 and the forward portion of the drill shaft 34), at its intersection with the 20-millimeter shell, representing the forwardly extended position of the drill.

Figure 4:
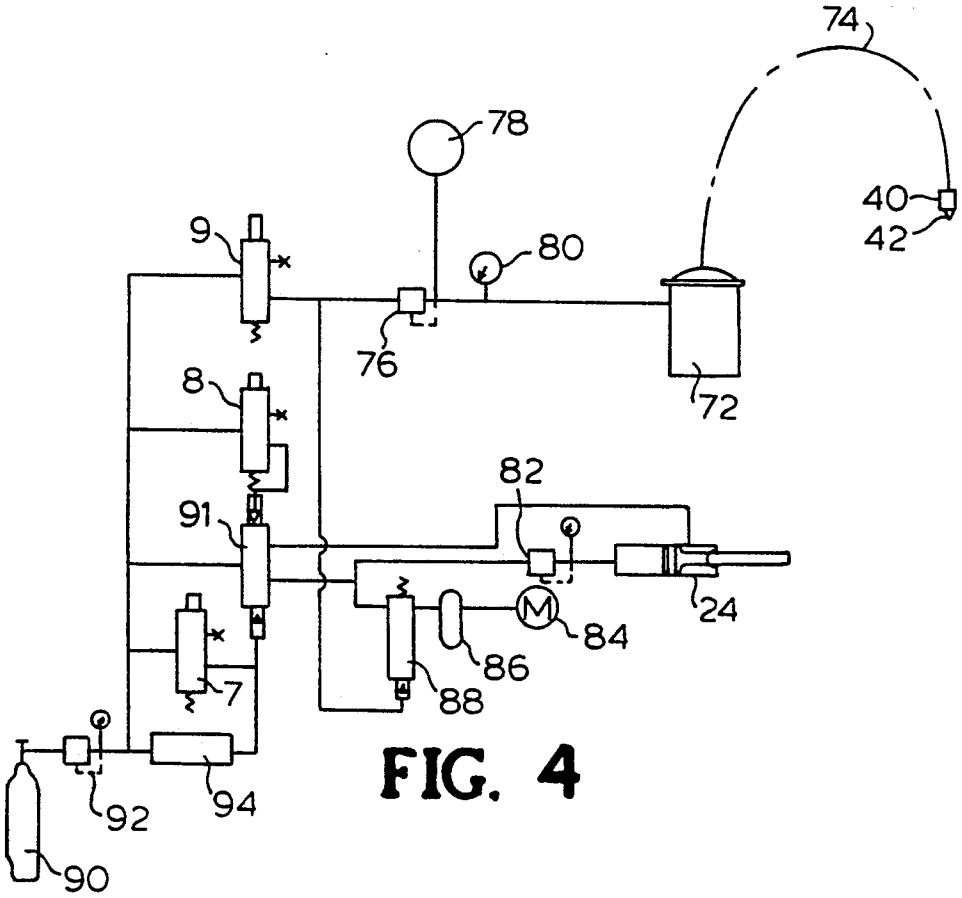
FIG. 4 is a schematic representation of a pneumatic system usefully employed with the penetration/mass transfer assembly of FIGS. 1-3.

FIG. 4 is a schematic representation of a pneumatic system which may be advantageously employed with the penetration/mass transfer apparatus of FIGS. 1-3, and wherein the same system elements are numbered correspondingly to FIGS. 1-3.

In the FIG. 4 pneumatic system, the injector head 40 featuring injector nozzle 42 is joined by means of feed line 74 to a pressurized product reservoir 72. Reservoir 72 is pressurized by air derived from a pressurized air supply tank 90, which may for example comprise a Scott TM air pack tank equipped with a regulator 92 and flow rate controller 94. The pressurized product reservoir 72 is fed by a gas supply line having associated therewith pressure regulator 76, signal 78, and pressure gauge 80.

The pneumatic system includes limit valves 7,8, and 9, control valve 91, control valve 88, in-line lubricator 86, air drill turbine 84, slide cylinder 24, and slide pressure regulator 82.

Figure 5:
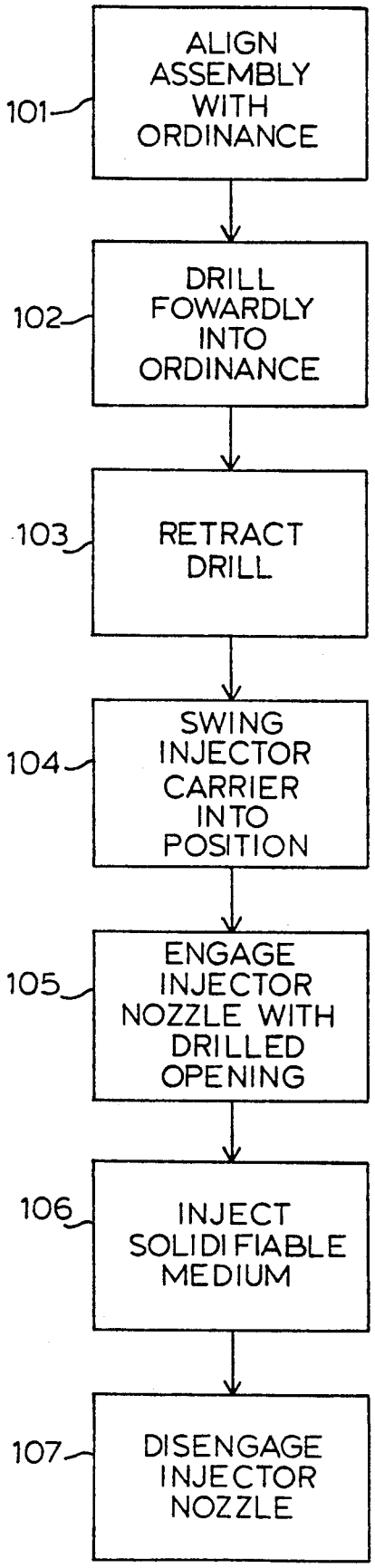
FIG. 5 is a schematic block diagram of process steps that may be utilized to carry out a penetration/mass transfer method in accordance with one embodiment of the invention, as for example with the apparatus assembly shown and described with reference to FIGS. 1-3 hereof.

In operation, as schematically represented by the flowchart of method steps 101 to 107 in FIG. 5, the pneumatically powered apparatus 10 of FIGS. 1-4 after alignment of the drilling/injection assembly with the ordnance article (step 101) may be usefully employed to drill an injection port through the ogive of an artillery projectile and through the fuse body therein (step 102). After the injection port has been drilled, the apparatus retracts the drilling tool (step 103), and swings the injector carrier into proper position (step 104) and engages the injector nozzle with the drilled opening (step 105). The apparatus then pressurizes the product reservoir 72 and injects the fuse with an anaerobic sealant which is employed as a gagging compound to immobilize certain components of the fuse (step 106). Finally, the injector nozzle is withdrawn from the drilled opening of the ordnance article (step 107).

The foregoing generalized description of the operation of apparatus 10 will now be specifically described with reference to the drawings of FIGS. 1-4.

Initially, an ordnance technician attaches the ordnance mounting fixture 50 to the ordnance article 60, and cocks the injector head 40 under the retaining bar 46. The technician then sets the delay time in an automatic control system (not shown) or a remote control actuator (also not shown) and turns on the compressed air supply 90, following which the technician is free to leave the area of the ordnance article and the drilling-/injection device coupled therewith.

The delay timer referred to above then "times out" and pilots the control valve 91, or alternatively, if a remote control actuator is being employed, the control valve 91 may be actuated with an encoded radio-type remote control device (not shown).

In either event, the output of control valve 91 passes through control valve 88 (which is normally passing), continues through in-line lubricator 86, and powers the air drill turbine 84. Simultaneously, a branch of the output from control valve 91 passes through regulator and flow control 82 and begins to extend the slide cylinder 24. A shock absorber 29 at the distal end of the shaft 35 extending from hydraulic checking cylinder 31 prevents the drill tip element 36 from being jammed into the projectile surface. Additionally, the hydraulic shock absorber 29 provides a smooth rate of advance of the drilling element 36 throughout the drilling cycle.

The drilling element 36 functions as a cutting tool, and is advanced through the casing of the projectile by the forward motion of the slide cylinder 24. During this operation, the air drill exhaust from air drill 28 is directed onto the drilling element 36 through a formed tube (not shown). In this manner, oil-saturated exhaust air will act as a coolant gas for the tool bit (drilling element 36).

When the drilling element 36 has reached the proper depth in producing a drilled opening 64 in the projectile, the stroke limiter adjustment screw at the end of stroke limiter 22 contacts the actuator of limit valve 8. The output of limit valve 8 then shifts the spool of control valve 91, and control valve 91 removes the air supply from the air drill 28 and slide cylinder advance port 26, and redirects it to the slide cylinder retraction port 32.

The slide of the slide cylinder then retracts, thereby removing the drilling element 36 from the drilled opening 64 so that the shaft 34 of the air drill 28 is rearwardly translated to its fully retracted position. The retaining bar 46 is thereby retracted off the cocked injector head 40 as the slide nears its rearward limit. Injector head 40 then rotates under spring 52 pressure, aligns with the drilled injection port 64, and opens limit valve 9.

The output of limit valve 9 pressurizes product reservoir 72 through a precision low pressure regulator 76 and simultaneously shifts the spool of control valve 88, initiating the flow of sealant material from reservoir 72 to injector head 40.

The stroke limiter 22 thereupon contacts limit valve 7 which repilots control valve 91. The output of control valve 91 to the slide cylinder 24 moves the slide forward until the cutting element 36 is pressed into the back side of injector head 40. The cutting element 36 then acts as a pressure ram on the injector head 40.

Sealant material from the reservoir 72, now pressurized, is flowed through the feed line 74, through the injector head 40, nozzle 42, and into the fuse body 62.

The sealant material then cures in the fuse body 62 and injector head 40. As mentioned, the sealant material may comprise an anaerobic sealant composition which in the oxygen-deficient conditions within the fuse body 62 and nozzle 42 and injector head 40, effects rapid solidification of the sealant composition to a final cured state. A visible signal then is emitted by signal element 78, notifying the ordnance technician that the curing of the sealant is complete. The technician then returns and removes the projectile from the mounting fixture 50. Concurrently, the disposable injector head 40 may be uncoupled from the drilling/injection system, and discarded. The inerting procedure is complete, and the inerted projectile may then be safely and readily disposed of.

It is within the purview of the present invention to provide the drilling member (drill bit) with a hollow central passage therewithin, with openings to the flutes at the distal portion of the drill bit and optionally a lateral protrusion on the outer surface of the drill bit to act as a limit stop defining the maximum depth of penetration of the drill bit into the ordnance article. In such fashion, the drill bit could be employed for drilling out the ordnance article to the selected maximum penetration depth, and remain in the drilled opening as the sealant material is flowed through the hollow central passage of the drill bit and through the flute openings into the interior of the ordnance device to inert the actuation mechanism. While avoiding the need for retraction of the drill bit before the initiation of sealant injection, such alternative modification requires a means for disengaging the drill bit from the air drill, and necessitates flow of sealant through the drill bit, which in turn requires the sealant to be flowed through the air drill into the drill bit held by the air drill device. Accordingly, the provision of a retractable drill and extendible/retractable injector head is preferred in practice.

Figure 6:
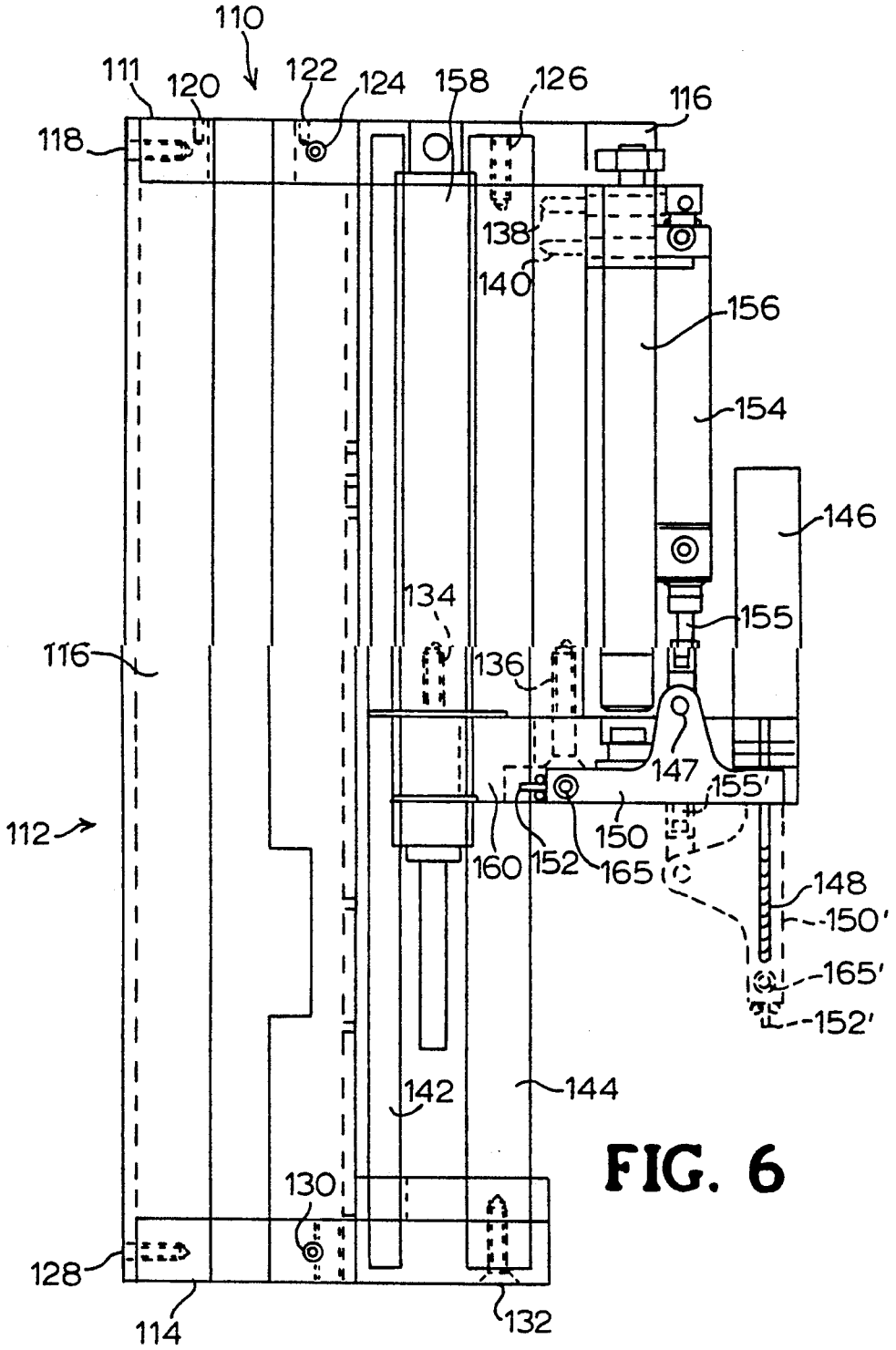
FIG. 6 is a front elevation view of a penetration/mass transfer assembly according to another embodiment of the invention.
Figure 7:
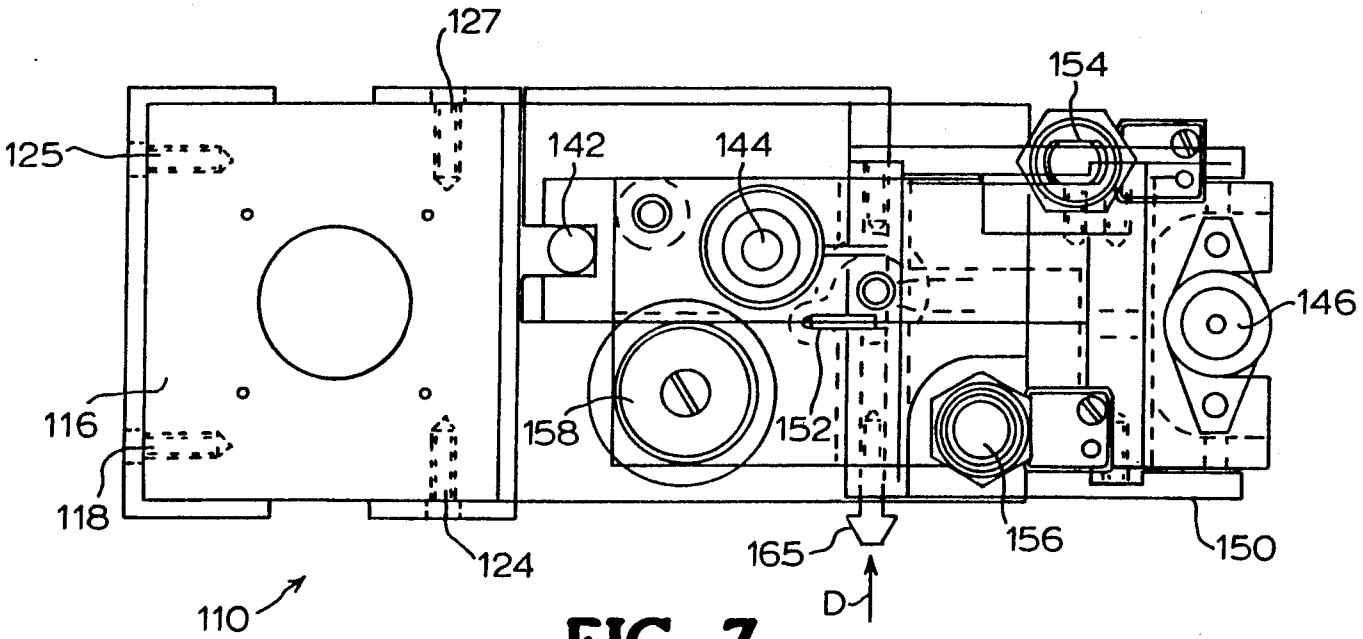
FIG. 7 is a top plan view of the penetration mass transfer assembly of FIG. 6.

FIGS. 6 and 7 show front elevation and top plan views of a unitary, modular, pneumatically operated, electrically controlled drilling/injection apparatus 110 such as may be employed for inerting of M500 series M.T. projectile fuses by automatically drilling an injection port into the projectile fuse, followed by pressure injection of an anaerobic sealant material such as Loctite Product 17380 (Loctite Corporation, Hartford, Conn.) into the fuse body.

The apparatus 110 of FIGS. 6 and 7 may be remotely activated for operation by a radio control signal from a wireless remote device, e.g., a 1.5 volts DC (VDC) signal output from an M122 wireless firing device. The apparatus may be pneumatically powered by a programmably controlled air supply system, such as for example a 2200 psi Scott TM air pack, controlled by a 24 VDC programmable controller which is powered by a suitable battery array. As an alternative to pressurized air, the apparatus may be powered by any other suitable pressurized inert gas, or other non-pneumatic power means, e.g., electrical, solar, etc. power means.

The unitary, modular apparatus 110 shown in FIGS. 6 and 7 includes a main body support 112 comprising upper transverse member 111 and lower transverse member 114 interconnected by guide rails 142 and 144. The guide rails are maintained in position by mechanical fasteners, e.g., screws, 126 and 132. On the left-hand side of the apparatus as shown in FIG. 6 is a housing 116 extending between the transverse members 111 and 114, and having mounted therewithin valving and pneumatic and electrical system elements (not shown), the assembly being held together in unitary form by mechanical fasteners including screws 118, 120, 122, 124, 126, 128, 130, 132, 134 and 136.

Mounted on the guide rails 142 and 144 in vertically slidable relation thereon is a transverse support member 160 on which in turn is mounted air drill 146 having drill bit 148 extending distally therefrom. Laterally adjacent to the air drill 146 is a pneumatic actuator cylinder 154 having a selectively extendible and retractable shaft 155 at its lower end which is joined by means of pin connector 147 to injector carriage 150 featuring sealant inlet port 165 and injector nozzle 152. The upper end of the pneumatic actuator cylinder 154 is secured to the body of the apparatus by means of screws 138 and 140. Laterally adjacent to pneumatic actuator cylinder 154 is a carriage advancing/retracting cylinder 156 by means of which the transverse support member 160 is selectively lowered or raised on the guide rails 142 and 144.

Mounted on the body of the apparatus, and shown between the guide rails 142 and 144 in the view of FIG. 6, is a hydraulic checking cylinder 158, serving to control the translational speed of the carriage member 160 under the driving impetus of the advancing/retracting cylinder 156.

Also shown in FIG. 6, in broken line representation, is a lowered position of the shaft 155' of the pneumatic actuator cylinder 154, with the injector carriage 150' in its active injection position, featuring lowered injector nozzle 152' and the sealant port 165'. The corresponding solid line representation of injector carriage 150, injector nozzle 152, and sealant port 165, as shown in the FIG. 6 drawing, is the retracted, inactive position of such structural sub-assembly.

The top plan view of FIG. 7 shows the unitary, modular apparatus 110 as including a left-hand portion (as illustrated in the drawing) which includes the valving and pneumatic and electrical system elements (not shown), such portion being in a housing secured to the frame or base structure, by mechanical fasteners 118, 124, 125, and 127.

The guide rails 142 and 144 are shown in transversely spaced-apart relation to one another, and in front of the guide rails is disposed the hydraulic checking cylinder 158. The pneumatic actuator cylinder 154 is shown at the rear part of the right-hand portion of the apparatus, behind advancing/retracting cylinder 156 and air drill 146.

The injector carriage 150 is shown in its retracted position in FIG. 7, with the injector nozzle 152 being transversely oriented, in a direction perpendicular to its extended active position, and with the sealant port 165 being frontally presented for introduction therethrough of sealant material from a suitable source (not shown) in the direction indicated by arrow D. As shown more clearly in the respective solid line and broken line representations in FIG. 6, the injector carriage 150 is selectively, swingably translatable between a retracted (horizontal) position and an extended, active (vertical) position.

Figure 8:
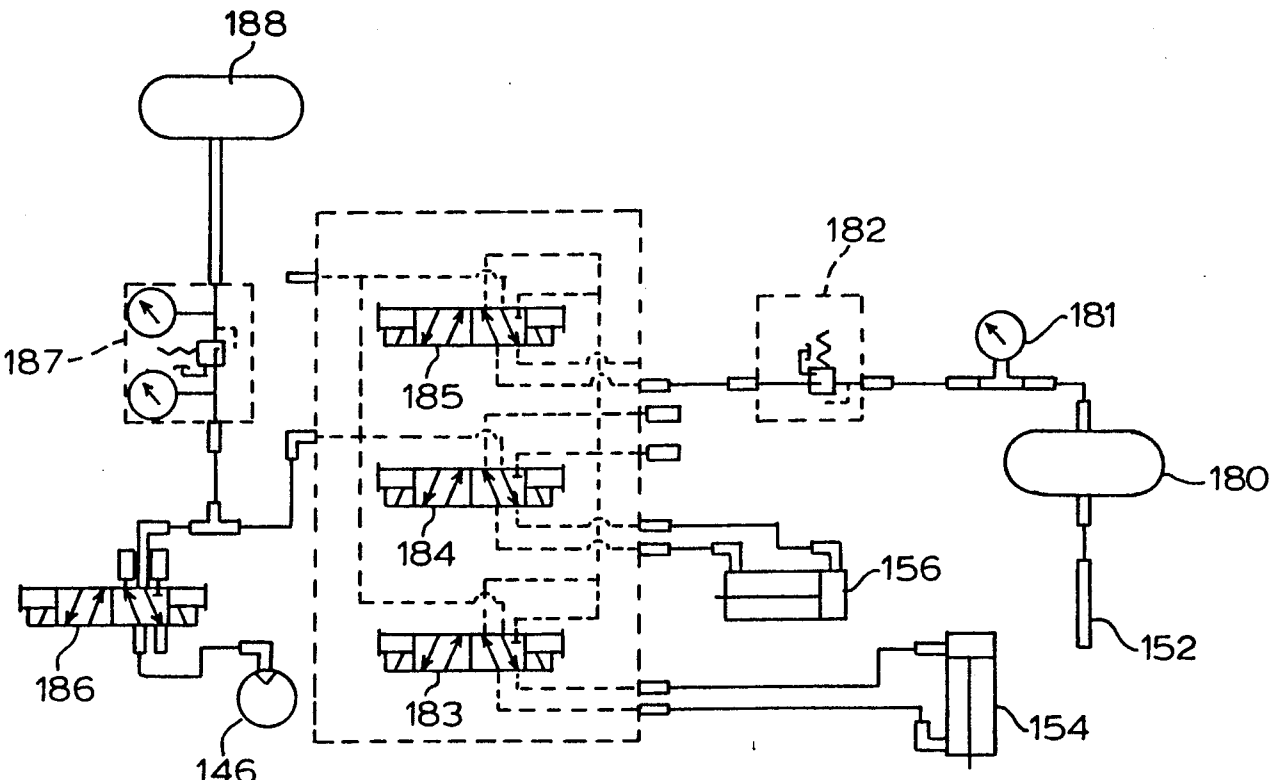
FIG. 8 is a schematic representation of a pneumatic system usefully employed with the penetration/mass transfer assembly of FIGS. 6 and 7.

FIG. 8 is a schematic flow sheet of a pneumatic system which may be usefully employed with the apparatus shown and described with reference to FIGS. 6 and 7. In the schematic circuit diagram of FIG. 8, parts and elements corresponding to those shown in FIGS. 6 and 7 are numbered identically therewith.

As illustrated in FIG. 8, a pneumatic valve sub-assembly comprising pneumatic valves 183, 184, and 185 is shown within the dashed line rectangle, together with the associated gas flow conduits interconnecting such valve elements. These valves include pneumatic injector valve 183, coupled in pneumatic flow control relationship with injector cylinder 154, slide valve 184 in pneumatically controlling relationship to slide cylinder 156, and injector pressure valve 185 in pneumatic controlling relationship with pressure regulator 182, pressure gauge 181, sealant reservoir 180, and injector nozzle 152.

Additionally, the slide valve 184 is coupled exteriorly with air motor valve 186, which is connected in controlling relationship to air motor 146, which motively drives the air drill in the drilling operation. Joined in air supply relationship to the gas flow conduit interconnecting air motor valve 186 and slide valve 184 is a pressurized gas supply 188, which may for example comprise a Scott TM air pack as the compressed air source for the pneumatic system. The gas supply 188 is provided with a high pressure regulator 187 for controlling the flow rate and pressure of the supplied gas.

Figure 9:
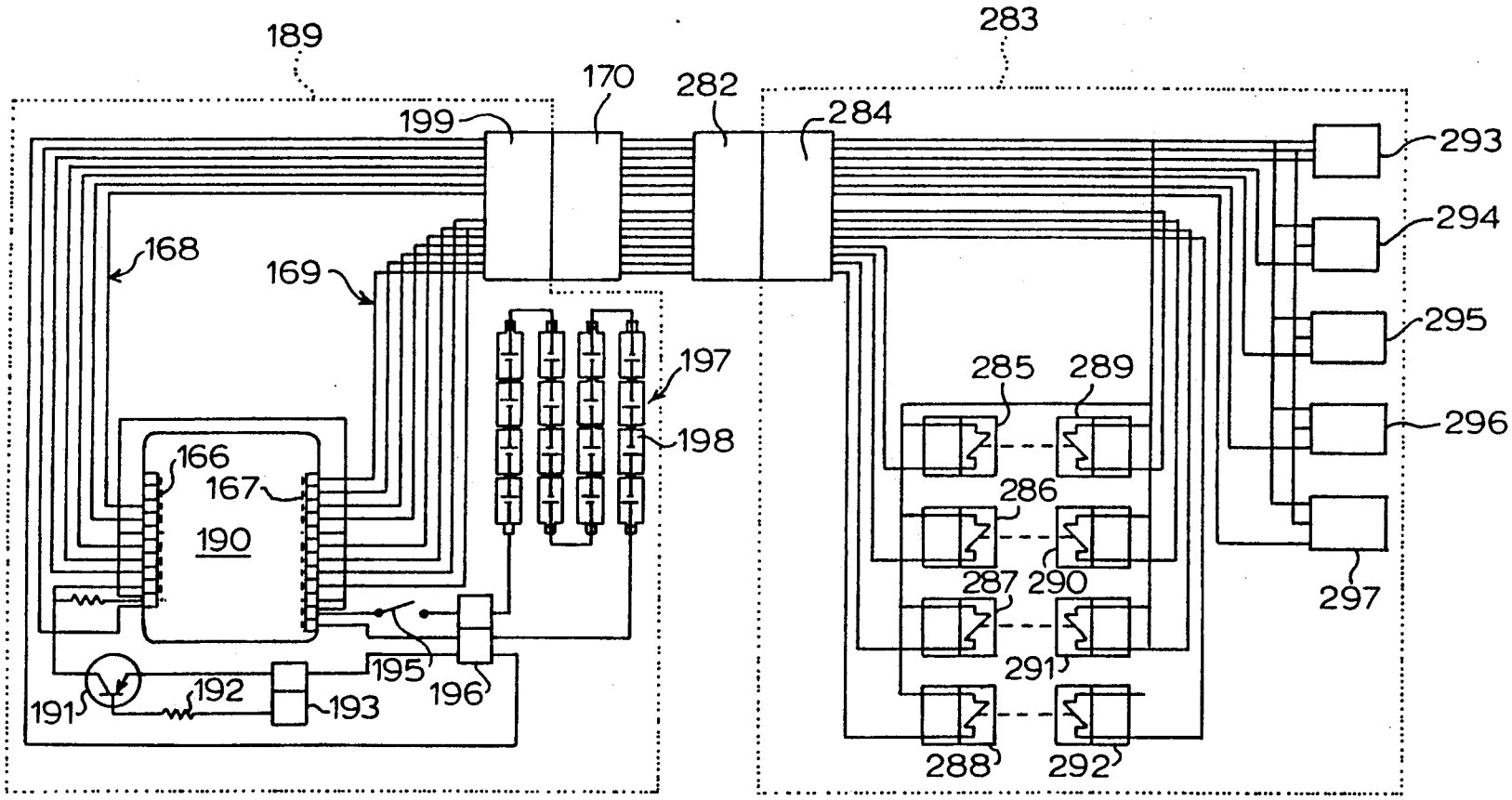
FIG. 9 is a schematic representation of an electrical/electronic system usefully employed with the penetration/mass transfer assembly of FIGS. 6 and 7.

FIG. 9 is a schematic circuit diagram of an electrical control system such as may be advantageously utilized with the drilling/injection apparatus shown and described with reference to FIGS. 6–8.

As shown in FIG. 9, the electrical system comprises a main power and controller portion 189 and a drill module portion 283, interconnected by means of the multi-wire cable connectors 199, 170, 282, and 284. Connector 199 is associated with the power/control portion 189, and connector 284 is associated with the drill module portion 283. A separate multi-wire cable connector, with connectors 170 and 282 at its respective ends, is employed to interconnect the respective portions 189 and 283, as shown.

In the power/controller portion 189, an array 197 of batteries 198, e.g., "D" cell batteries, is provided, to supply power to the programmable controller 190 upon closure of switch 195.

An array 168 of input wires is connected to the input terminals 166 of the programmable controller 190. An array 169 of output wires is connected to output terminals 167 of the programmable controller 190, and to connector 199 of the power/controller portion 189 of the electrical system.

The circuitry elements associated with the programmable controller 190 in portion 189 include transistor 191, resistor 192, trigger binding post 193, and auxiliary power binding post 196, corporately facilitating a remotely-actuatable initiation of the operational sequence under the control of programmable controller 190.

The circuitry and programmable controller are actuatable by means of a wireless remote firing device which provides a 1.5 volt DC signal to the trigger binding post, which causes transistor 191 to be tripped, thereby starting the operational sequence. Auxiliary power is introduced by means of auxiliary power binding post 196, when switch 195 is closed.

In the drill module portion 283, an array of solenoid actuated valves 285, 286, 287, 288, 289, 290, 291, and 292 are arranged as illustrated, and connected by signal transmission wires to the drill module connector 284, which also accommodates multiwire connection, as illustrated, with electrical valve controllers 293, 294, 295, 296 and 297.

Considering the drill module portion 283 in greater detail, the solenoid actuated valves are arranged in pairs, as shown. Valves 285 and 289 are interconnected, with valve 285 having air drill "OFF" output, and valve 289 having air drill "ON" output; valve 286 is paired with valve 290, valve 286 having slide cylinder "UP" output and valve 290 having slide cylinder "DOWN" output; valves 287 and 291 are paired, with valve 287 having an injector nozzle "UP" output and valve 291 having an injector nozzle "DOWN" output; and valves 288 and 292 are paired, with valve 288 having a sealant reservoir pressure "OFF" output and valve 292 having a sealant reservoir pressurization "ON" output.

Control valve actuators 293, 294, and 295 are associated with the slide cylinder (carriage advancing/retracting cylinder 156—see FIGS. 6 and 7), controller 293 translating the slide cylinder to a slide "UP" position, controller 294 translating the slide cylinder to a slide "DOWN" position, and controller 295 translating the slide cylinder to a further "DOWN" position, corresponding to the drilling by air drill 146 (see FIG. 6) into the projectile being inerted by the apparatus. Controller 296 controls the pneumatic actuator cylinder 154, translating same to a nozzle "UP" position, and controller 297 translates the pneumatic actuator cylinder 154 to a nozzle "DOWN" position.

The drilling/injection apparatus illustratively described in connection with FIGS. 6–9 above may utilize a conventional drilling element 148, e.g., a 0.125 inch diameter cobalt or high speed twist drill, or alternatively, specially designed cutting tools capable of being held in the collet of air motor 146 may be employed. The drilling depth may by way of illustration be adjustable from 0–2 inches and may be preset by the ordnance technician or other operator of the apparatus. The drilling element may be selected to penetrate a variety of materials, such as steel, aluminum, zinc, brass, iron, and alloys, laminates, and composites thereof, as well as plastic, ceramic, and other structural materials.

The drilling/injector apparatus 110 of FIGS. 6–9 may be provided with a variety of visible or audible output devices to signal completion of operation. Such signal output means may be powdered by the battery array 197 of the apparatus (see FIG. 9).

In initial deployment, the drilling/injection apparatus may be provided with a sight glass or other alignment means, by which the drilling element, and subsequently, the injector nozzle coaxially aligned therewith when the drilling element is retracted, are brought into proper orientation and positional relationship to the drillable article or site. For example, a sight glass featuring a cross-hair centering device may be provided, so that the drilling element is placed in proper alignment with the ordnance article to be drilled. The drilling element preferably should be oriented perpendicular to the ordnance surface to be drilled.

The unitary modular assembly shown in FIGS. 6 and 7 may be secured on any suitable support, carriage, or base structure, and/or associated with any fixturing, mount, or retention sub-assembly for associating or positioning the article to be drilled, in drilling and injection proximity to the drill and sealant injector of the apparatus.

In operation of the drilling/injection apparatus, which is shown and described with reference to FIGS. 6–9, the pressurized air source 188 (see FIG. 8) is connected to the high pressure regulator 187, and the sealant reservoir 180 is filled with a suitable sealant material and connected to the sealant portion 165 of injector carriage 150, so that the pressurized sealant reservoir 180 directs sealant material to the injector nozzle 152 upon initiation of the injection sequence.

After the air supply and sealant supply are set up, and the article to be drilled is properly aligned with the apparatus for the drilling and injection operations, the electrical system of apparatus 110 is actuated by remote control, such as by an M122 firing device providing a 1.5 volt DC input signal which trips transistor 191 to initiate the drilling/injection sequence.

Subsequently, in sequence, the steps 102–107 shown and described with reference to FIG. 5, are carried out. The air drill 146 is actuated, and the carriage advancing/retracting cylinder is actuated to advance (lower) the transverse carriage member 160, to initiate drilling of drill element 148 into the ordnance article. When drilling has proceeded to a predetermined depth of penetration of the drill element 148, the transverse carriage member 160 is retracted by upward translation of the shaft (not shown) associated with carriage advancing/retracting cylinder. The drilling element 148 is retracted to be clear of the drilled article, to sufficient extent to allow subsequent movement of the injector carriage 150 to the position indicated by broken line representation of injector carriage 150' in FIG. 6, so that the injector nozzle 152' is aligned with the drilled opening of the ordnance article. Such translation of the injector carriage 150 is effected by actuation of the pneumatic actuator cylinder 154, to cause extension of the actuator shaft 155. The actuator shaft 155 is connected at its lower end, such as by a clevis connection, to pin connector 147, so that rotation of the clevis about pin connector 147 is readily accommodated when the shaft 155 is downwardly extended. During such downward extension of shaft 155, the left-hand portion of injector carriage 150 as shown in FIG. 6, is downwardly swung through an arc of 90° to the position indicated in broken line representation, with the corresponding extended position of shaft 155 being indicated in broken line representation as shaft 155'. The right-hand portion of injector carriage 150 is pivotally secured to the transverse carriage member 160, allowing rotation of the left-hand portion through the aforementioned arc, about the fixed translation axis of the right-hand portion of the injector carriage.

Once the injector nozzle 152 is swung into position 152' below and in coaxial alignment with retracted drilling element 150', the pneumatic and electrical systems effect flow of pressurize sealant from reservoir 180 through port 165/165' and through nozzle 152', after the nozzle has been inserted into the drilled opening, by corresponding lowering of transverse carriage member 160 to a predetermined appropriate extent. The interior volume of the ordnance article in communication with the drilled opening then is filled with the rapidly solidifiable sealant material, which is originally flowable, but in the interior volume of the ordnance article cures rapidly to a solid form, thereby immobilizing and rendering inoperative the actuation mechanism of the ordnance device.

The above-described sequence of steps associated with the drilling/injection operation are carried out with appropriate translation of the transverse carriage member 160 and injector carriage 150, by means of the pneumatic and electrical systems of FIGS. 8 and 9, respectively.

Figure 10:
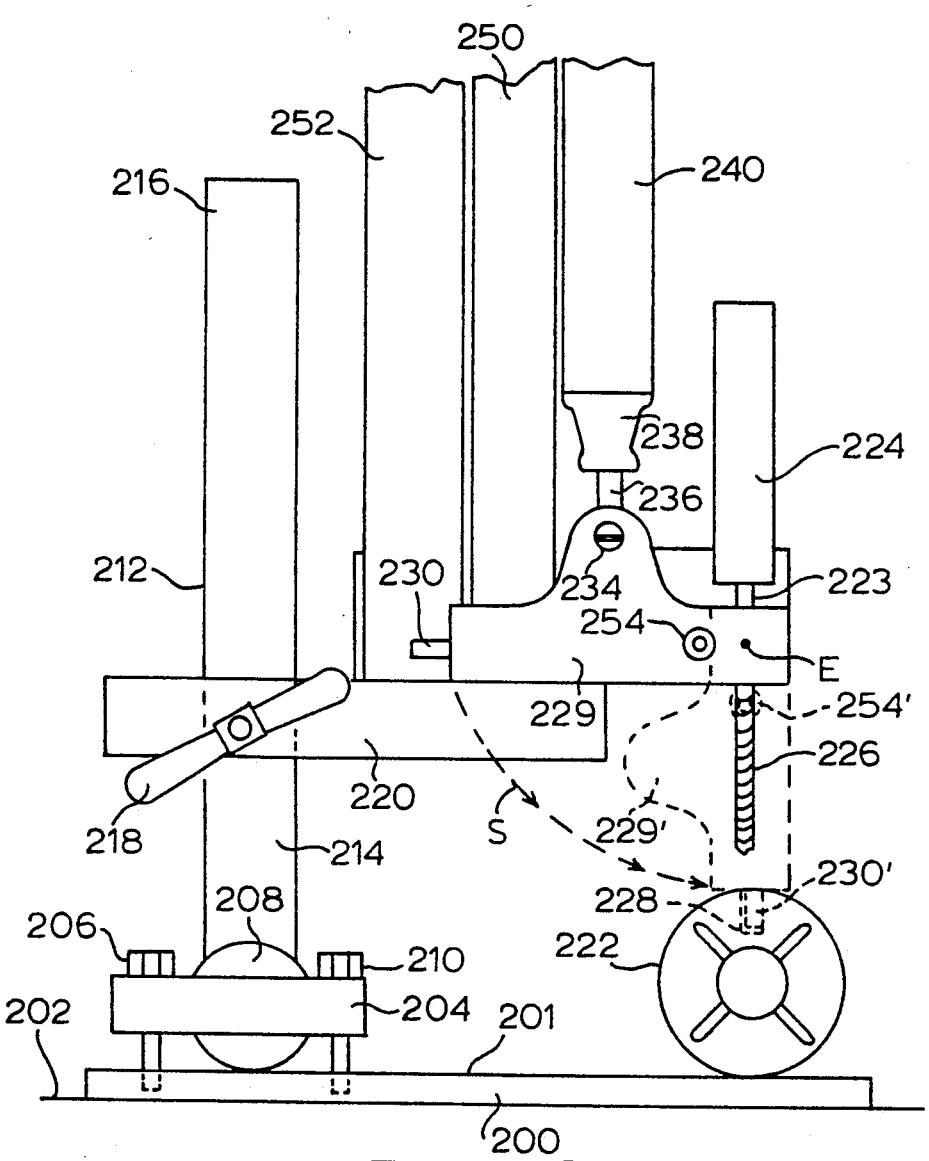
FIG. 10 is a front partial elevation view of another penetration/mass transfer assembly according to yet another embodiment of the invention.
Figure 11:
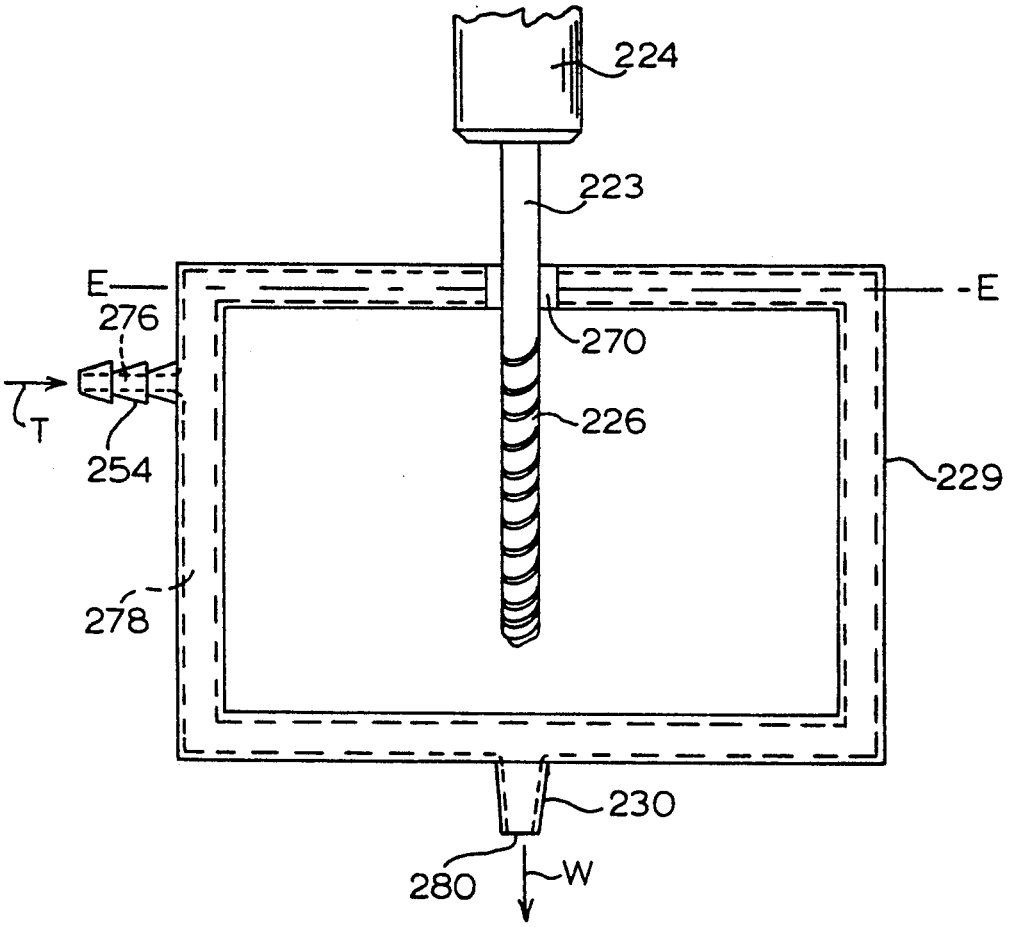
FIG. 11 is a side elevation view of a portion of the assembly of FIG. 10, showing part of the drilling and injection subassembly thereof.

FIGS. 10 and 11 show respective views of portions of an apparatus according to another embodiment of the invention, similar to that illustratively described in connection with FIGS. 6–9.

In the FIG. 10 embodiment, a unitary, modular penetration/mass transfer apparatus comprises air drill 224 having shaft 223 with cutting surface 226 at its distal end, extending downwardly from the body of the air drill 224. Adjacent to the air drill is a pneumatic actuator cylinder 240 having a lower collar portion 238 from which vertically downwardly extends a selectively extendible and retractable shaft 236. The shaft 236 is joined, such as by a clevis-type coupling arrangement, to coupling pin 234 of injector carriage 229 (having injector nozzle 230 extending laterally therefrom in the retracted position illustrated in FIG. 10). The injector carriage 229 is selectively pivotally translatable about pivotal axis E, from the retracted position shown in FIG. 10 in solid line representation, to the extended injection position shown in broken line representation in the drawing, as comprising injector carriage 229' and injector nozzle 230' thereof.

The injector carriage 229 is provided with a sealant port 254 thereon, which is coupleable in sealant supply relationship with a source of suitable sealant material (not shown).

Laterally adjacent to pneumatic actuator cylinder 240 are (1) a carriage advancing/retracting cylinder 250, by means of which the drill/injector sub-assembly may be selectively raised and lowered, and (2) hydraulic checking cylinder 252, which serves to impart a smooth and steady character to the translational movements of the drill/injector sub-assembly under the impetus of the advancing/retracting cylinder 250.

In operation, the ordnance article 222 is drilled with the drill bit extending from air drill 224 after the air drill is actuated pneumatically and the drilling/injector assembly is unitarily lowered, under action of the advancing cylinder 250. After the drilling has proceeded to the selected depth, resulting in a drilled opening 228 being formed in the ordnance article communicating with its interior region, the drill bit comprising shaft 223 and cutting surface 226 is retracted by retraction cylinder 250. The pneumatic actuator cylinder 240 is controllably operated to extend the shaft 226 resulting in translation of the injector carriage 229 through the swing arc indicated by arrow S in FIG. 10, to the corresponding position indicated by broken line position 229', whereby the nozzle 230 is swung from a horizontal orientation in the retracted position illustrated in FIG. 10, to a vertical downward extending position 230', as shown. The drilling/injection sub-assembly then is unitarily lowered by cylinder 250 to insert nozzle 230' into opening 228 drilled in ordnance article 222 by the cutting surface 226 of the drill bit (such drill bit having been retracted from the ordnance article by cylinder 250 operating in its retraction mode, to provide the necessary clearance to allow swing-down of carriage 229 into the injection position above ordnance article 222).

With the drilling/injection sub-assembly is lowered by cylinder 250 to place nozzle 230' in opening 228, a pressurized sealant introduced by sealant port 254 into injector carriage 229 and discharged from injector carriage 229 through nozzle 230' into the interior volume of the ordnance article 222.

After the sealant injection operation has been completed, the drilling/injection sub-assembly is retracted by the cylinder 250, so that injector nozzle 230' is removed from drilled opening 228 of the ordnance article. The injected sealant then cures rapidly to a solid form, thereby precluding the normal operation of the actuation mechanism of the ordnance article, and rendering the ordnance article safe for handling and subsequent disposal.

Although the drilling/injection sub-assembly of the apparatus of FIG. 10 has been shown somewhat schematically, it will be recognized that the unitary, modular assemblage of air drill 224 and its associated drill bit, cylinder 240 and injector carriage 229 and nozzle 230, cylinder 250, and cylinder 252, may be constructed and arranged in any suitable manner, consistent with the drilling and injection operations sequentially carried out by the apparatus, involving advancement of the drilling/injection sub-assembly comprising injector carriage 229 to operative position, and subsequent retraction, as required for the operation of the apparatus.

Thus, the unitary, modular drilling and injection sub-assembly comprising air drill 224, and cylinders 240, 250 and 252, may be interconnected in any suitable fashion, and may, as illustrated, be mounted on a base bracket 220 for support of the drilling/injection sub-assembly above the ordnance article 222 to be inerted.

The base bracket 220 in the illustrated embodiment is slidably mounted on base column 212 for vertical movement thereon between the lower portion 214 thereof and upper portion 216 thereof. The base bracket 220 is fixedly securable at any selected vertical altitude along base column 212 by means of manually tightenable/loosenable adjustment knob 218.

At its lower extremity, the lower portion 214 of base column 212 features a swivel ball 208 which is pivotally secured by means of base clamp member 204. The base clamp member in turn is joined by means of bolt fasteners 206 and 210 to base plate 200, which on its upper surface 201 features threaded openings in which the threaded lower portions of bolts 206 and 210 are received.

The base plate 200 is suitably reposable on a ground or floor surface 202, and the base column 216 may be pivotally secured at any selected orientation relative to base plate 200, consistent with the pivotable character of swivel ball 208.

In assembly, the base plate 200 is first reposed on a supporting surface 202, following which the ordnance article 222 may be reposed on the top surface 201 of the base plate, and the base column then may be positioned in the desired attitude and orientation on the base plate. Next, the base clamp 204 may be tightened against the swivel ball by selective tightening of the bolts 206 and 210 in their respective base plate openings, to place the base clamp in compressive bearing relationship against the swivel ball, so that the base column thereby is fixedly retained in the selected position.

Following such positioning of the base column 212, the base bracket 220 may be positioned at the desired elevation on the base column. The drilling/injection sub-assembly then may be mounted on the base bracket, as for example by means of upwardly extending pin members inserted into receiving openings (not shown) on the bottom surface of the drilling/injection sub-assembly. Alternatively, the drilling/injection sub-assembly may be detachably, or permanently, secured to the base bracket 220, so that the combined drilling-/injection and base bracket sub-assembly may be inserted onto base column 212 and secured in place at a desired elevational position, by manual adjustment knob 218 which is selectively tightened to fixedly retain the drilling/injection sub-assembly in position relative to the ordnance article.

Subsequent to such assembly of the apparatus shown in FIG. 10, the drilling and mass transfer operation may be carried out in a manner similar to that illustratively shown and described with reference to FIGS. 6–9 herein.

FIG. 11 is front elevation view of a portion of the drill and injector carriage and nozzle structure of the FIG. 10 apparatus.

As shown, the pneumatic drill 224 has a drill bit comprising shank portion 223 and drill bit cutting surface 226 extending downwardly therefrom, and the injector carriage 229 is constructed with a rectangular frame-like structure as shown in the front view of FIG. 11, with an opening 270 in the upper vertical member accommodating positioning of the shank 223 of the drill bit between adjacent ends of the injector carriage 229 at such portion of the structure.

The injector carriage 229 thus comprises an upper transversely extending portion comprising respective right-hand and left-hand segments which define a space therebetween receiving the shank 223 of the drill bit, together with a lower transverse member, and respective vertically extending side members. Each of the top, bottom, and side members of the injector carriage 229 has an interior hollow passage 278 therein communicating at the left-hand vertical member with the internal passage 276 of sealant port 254. As shown, the sealant port 254 is provided with a barbed fitting to accommodate coupling thereto of connecting tubing, as used to convey sealant material from a suitable reservoir (not shown) to the sealant port 254, for subsequent flow into the interior passage 278 of the injector carriage 229. Such interior passage 278 of the carriage communicates with the interior opening 280 of injector nozzle 230 at the lower end of the carriage structure, whereby discharge of sealant material from the injector carriage through passage 280 of injector nozzle 230 is accommodated, with the discharged sealant material being outwardly flowed in the direction indicated by arrow W in FIG. 11.

In operation, the injector carriage 229 is swingably pivotable about axis E—E as shown in FIG. 11. The injector carriage thereby may be swung through an arc S as shown in FIG. 10, from a horizontal retracted position to a vertical operative position, while accommodating the position of the drill bit (comprising shank 223 and cutting surface 226) and the appertaining drilling operation effected by such drill device.

Figure 12:
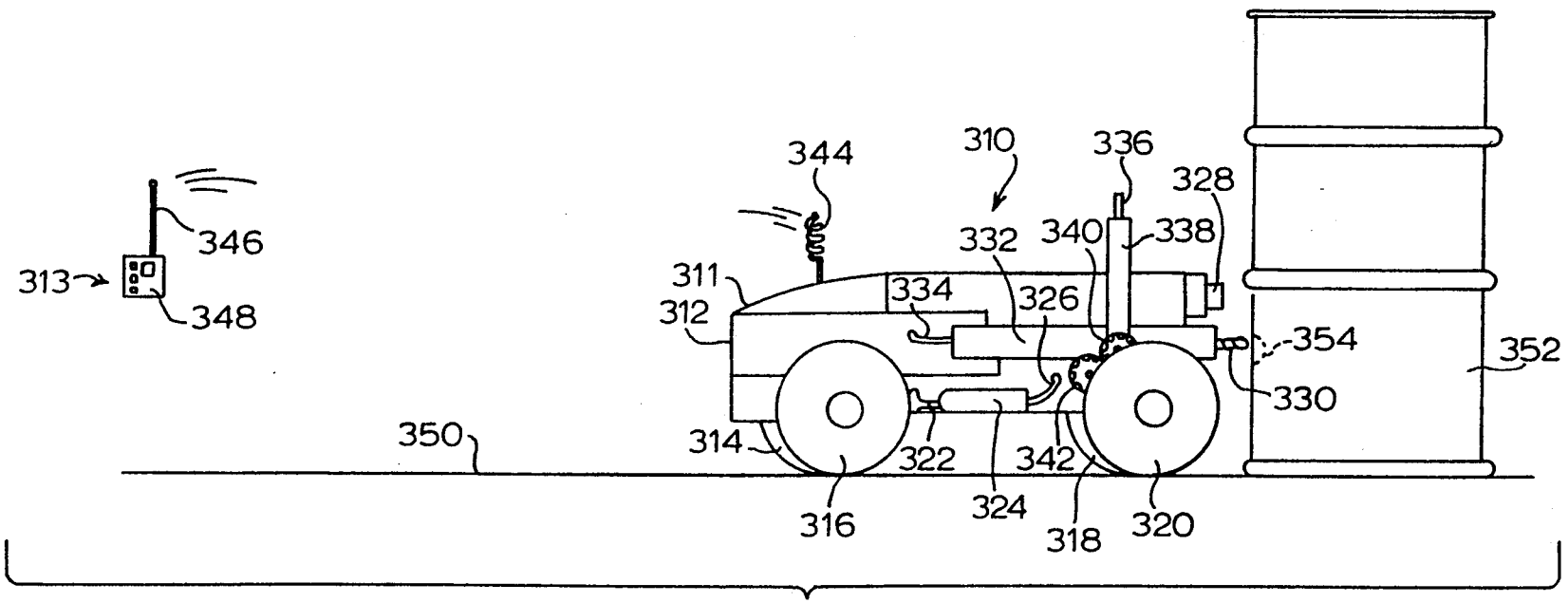
FIG. 12 is a perspective view of a mobile, remote control penetration/mass transfer assembly of the invention, in a further embodiment thereof.

FIG. 12 is a perspective elevation view of an apparatus according to another embodiment of the invention, which is usefully employed for sampling of a fluid medium from a penetrable situs.

Referring to FIG. 12, there is shown a drilling/sampling apparatus 310 comprising a remotely controllable vehicle 311 and a remote controller unit 313. The remotely controllable vehicle 311 has mounted thereon a drill 332 which is joined by power cable 334 to a power supply and actuator means (not shown) interiorly disposed in the housing of the vehicle.

By means of the internal power supply and actuator means, the drill 332 is selectively actuated and powered to (i) rotate the drilling element 330 of the drill at a selected rotational speed appropriate to the penetration of the specific situs, and to (ii) selectively forwardly advance or rearwardly withdraw the drilling element 330, as appropriate for penetration of the situs, or retraction of the drilling element therefrom, respectively.

The power supply and actuator means may be of any suitable type which is responsive to operational signal(s) from the remote controller unit 313, either directly via signals from the remote controller unit specific to each operational step of the drill 332, or indirectly to a master control from the remote controller unit 313 which initiates a programmed operational sequence of steps (turn-on of the drill, advancement of the drilling element, and retraction of the drilling element) under the direction of a responsive microprocessor unit in the interior of the vehicular housing.

It will be recognized that the power supply and actuator means associated with the drill 332 may be electrical, electronic, hydraulic, pneumatic, etc. as necessary or desirable in a specific application.

Associated with the drilling components of the apparatus 310 is a sampling assembly including a sampler arm 338 having a sampler nozzle 336 at its distal end. The sampling assembly is constructed and arranged so that upon retraction of the drilling element 330 following drilling penetration of the situs, the sampler arm is downwardly swingable from its vertical (inactive) position as shown in FIG. 12, to a horizontal position at which the sampler nozzle is aligned with the opening formed in the situs by penetration thereof by the drilling element.

Upon such alignment, the sampler nozzle is advanceable from the sampler arm into the penetration opening and interior of the situs. Once it is interiorly situated in mass transfer communication with the interior volume of the situs, the sampler nozzle may be utilized for carrying out the desired mass transfer operation, such as withdrawing mass from the interior volume of the penetrated situs.

Alternatively, the sampler nozzle in mass transfer communication with the interior volume of the penetrated situs may be utilized to inject mass, e.g., a reactant, diluent, treating agent, etc., through the interior passage of the sampler nozzle into the interior volume of the penetrated situs.

Subsequent to carrying out the mass transfer operation, the sampler arm is controllably upwardly swingable (by means interiorly disposed within the housing of the vehicle, and not shown in FIG. 12) to its original retracted position, shown in the drawing.

The construction, arrangement, and operation of the sampler assembly is hereinafter more fully described with reference to the sampling of the contents of container 352, as shown in FIG. 12 in conjunction with the drilling/sampling apparatus 310.

As illustrated in FIG. 12, the remotely controllable vehicle comprises a main body portion mounted on wheels 314, 316, 318, and 320 which are motively driven (by drive means not shown). The vehicle is remotely operable by remote controller 313 comprising an actuator unit 348 having a transmission antenna 346 affixed thereto. The actuator unit 348 is adapted for generation and transmission of a radio frequency signal, which is receivable by reception antenna 344 mounted on the rear upper surface of the drilling/sampling vehicle.

The reception antenna 344 is connected to suitable control systems, which cause the drilling/sampling vehicle to be selectively driven over a ground or floor surface 350 to the situs to be penetrated, where the situs is penetrated and subjected to mass transfer processing. These control systems associated with the driving of the vehicle may be integrated with control systems for the operation of the above-described drilling and sampling (mass transfer) means, e.g., utilizing an on-board microprocessor or computer control system, or the control systems may otherwise be discrete or alternatively couplingly arranged with respect to each other.

In the embodiment shown in FIG. 12, the drilling-/sampling vehicle 311 is provided with a wheel brake 322 engageable with wheel 316 as shown, to maintain the vehicle in a fixed location during the drilling and sampling operations. The brake element 322 is slidably reposed in hydraulic cylinder 324 connected by hydraulic fluid supply line 326 to a hydraulic control system interiorly disposed in the vehicle. By such means, the brake element 322 is selectively engageable with wheel 316 when the vehicle is piloted by remote control to the desired drilling/sample location.

At the desired drilling/sampling location, the vehicle 311 may be automatically stopped when proximity sensor 328, e.g., a laser-based distance monitoring device, senses that the apparatus 310 is in appropriate location for drilling and sampling. The brake element 322 is then actuated. The drill 332 then is actuated to effect rotation of drilling element 330 at a selected rotational speed appropriate to the drilling operation, and to cause the rotating drilling element to be advanced for drilling through the wall of the container 352.

The drilling operation may be carried out with the extent of advancement of the drilling element into the container be pre-set, e.g., 3 centimeters forward travel, or alternatively the advancement of the drilling element may be carried out in response to a sensed characteristic such as differential speed of the drilling element - i.e., when the drilling element, rotating at the initially set or inherent rotational speed level, first encounters the container wall, there will be a diminution of the rotational speed due to the penetration resistance of the container wall, and when the drilling element "breaks through" the container wall, there will be a corresponding increase in the rotational speed of the drilling element, as the penetration resistance of the container wall is finally overcome.

The first rotational speed differential, which is sensed at first contact with the container wall, may therefore be used to compensatingly increase the speed of the drilling element, or the associated driving torque, and the second rotational speed differential, which is sensed at breakthrough of the container wall, may be used to initiate retraction of the drilling element, either at that point in time or upon a time delay allowing further penetration of the container.

Upon completion of the drilling operation and retraction of the drilling element, the mass transfer operation may be initiated. At this point, the control system for the mass transfer assembly is actuated. This control system may in the illustrative embodiment comprise a drive means (not shown) interiorly disposed in the vehicle housing which is actuated to cause counterclockwise rotation of gear 342 and resulting clockwise rotation of gear 340. The gear 340 is motively coupled to the sampler arm 338 having sampler nozzle 336 at its distal end. When the gear 340 is rotated in a clockwise direction, the sampler arm is caused to swing downwardly through an arc of 90° in a clockwise direction for alignment with the penetrated situs 354, following which the sampler nozzle 336 is hydraulically forwardly translated from the sampler arm 338, into the drilled opening 354.

Once the sampling nozzle 336 is interiorly disposed in container 352, a vacuum is drawn in the nozzle by suitable vacuum-drawing means, (not shown in FIG. 12), and the flowable contents (in flow communication with the nozzle 336) are withdrawn from container 352 through sampler arm 338 to a suitable reservoir (not shown) interiorly disposed within the body of vehicle 311.

The interior reservoir in which the extracted material is collected may simply constitute a sample storage means which is selectively removable from vehicle 311 for subsequent testing testing and analysis. Alternatively, the collection reservoir within the body 312 of vehicle 311 may simply retain the extracted fluid for subsequent flow to suitable testing, monitoring, or analysis devices in the vehicle which can provide an output signal, e.g., transmittable by antenna 344 to remote control unit 348 indicative of the hazardous or non-hazardous character of the extracted fluid.

It may be desirable in some instances to provide the vehicle 310 with the capability for vertical elevation of the body 312, so that progressive samplings at different elevations can be achieved. For example, in the case of the storage container 352, sampling could be initiated with the vehicle body 312 in elevated position so that sampling takes place at the upper portion of the vessel, then at successively lower elevations until liquid is reached; by this expedient, a vessel can be sampled with a minimal spillage of its contents, since such spillage may itself require further decontamination or clean-up, in the event that the material within container 352 proves to be hazardous in character.

Alternatively, the drill 332 may be constructed with a forward collection receptacle below drilling element 330, whereby upon the initiation of drilling, any spillage is immediately collected in the collection receptacle and transferred to storage within body 312 of the vehicle, e.g., in a suitable collection/storage reservoir. Alternatively, the penetration and mass transfer means of vehicle 310 may potentially be consolidated in a unitary drilling/extraction device, whereby penetration is effected and extraction initiated without the necessity of withdrawing the penetration element from the penetrated situs.

Accordingly, the mass transfer operation contemplated in the practice of the present invention may constitute filling of the interior region of a penetrated situs with a selected material, and/or extraction of material from the interior region of a penetrated situs (with removal of same to an exterior collection point or other mass transfer site external to the penetration opening of the penetrated situs).

Further, as variously illustrated in FIGS. 13–17, the penetration means usefully employed in the practice of the invention may be widely varied, as necessary or desirable to a given end use application involving a specific penetrable situs.

Figure 13:
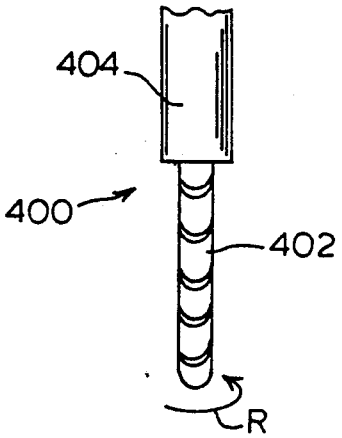
FIG. 13 is a front elevation view of a portion of a drilling subassembly potentially usefully employed as a penetration means in the practice of the invention.

FIG. 13 shows a portion of a drilling device including distal portion 404 of a drill 400, having drill bit 402 extending downwardly therefrom, with the drill being operable to effect rotation of the drill bit 402 in the direction indicated by arrow R, similar to the operation of the drilling elements variously described hereinabove in illustrative embodiments of the invention.

Figure 14:
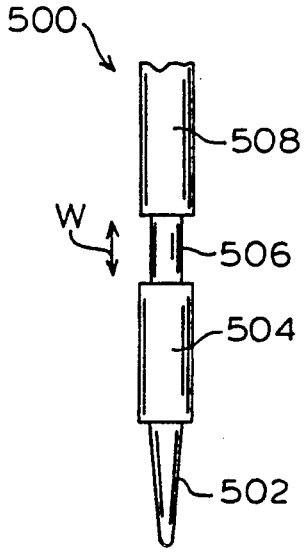
FIG. 14 is a front elevation view of a portion of an impact penetration subassembly potentially usefully employed as a penetration means in the practice of the invention.

FIG. 14 is a front elevation view of a portion of an impact penetration device 500, which may be employed to pierce a penetrable situs. At the lower portion of the penetration device 500 is a piercing element 502 in the shape of a conventional punch, which is connected to collar fixture member 504. The collar fixture member 504 in turn is mounted for slidable movement along shaft 506, in the directions indicated by arrows W in the drawing. The shaft 506 in turn is connected to hammer member 508, which is selectively periodically downwardly translated along shaft 506 for impact with collar fixture member 504, to force the piercing element 502 downwardly into a penetration site. Subsequent to such impact driving of the piercing element 502, the collar 504, which is spring-biased internally thereof against shaft 506, is returned to the extended position shown in FIG. 14. Thereafter, the hammer member 508 is downwardly directed for repeating impact with the collar 504 and renewed application of penetration force on the piercing element 502.

Figure 15:
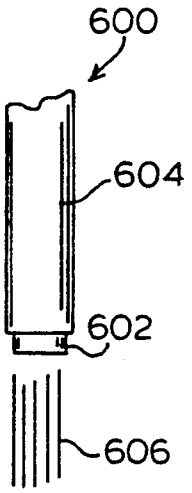
FIG. 15 is a front elevation view of a portion of a lasing subassembly potentially usefully employed as a penetration means in the practice of the invention.

FIG. 15 shows a portion, in frontal elevation, of a lasing penetration device 600 comprising optical fiber 602 clad in a sheathing 604 and coupled at a distal end of the fiber 602 to a suitable source of laser radiation, whereby the fiber acts as an optical wave guide to discharge the laser radiation 606 in conventional fashion from the distal end of the optical fiber. The laser radiation 606 is of a suitable intensity for lasing penetration of the target situs, and may comprise any laser type effective for such purpose.

Figure 16:
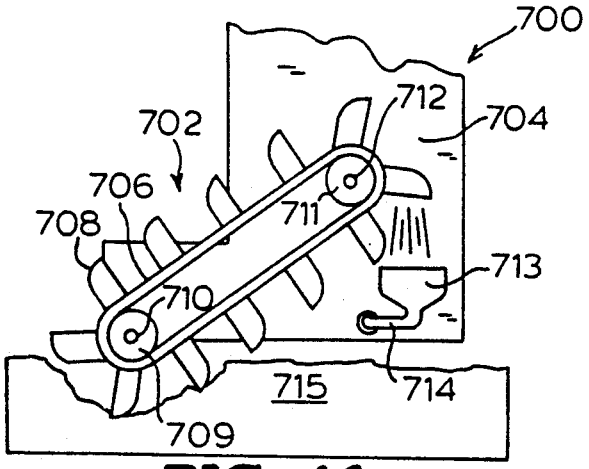
FIG. 16 is a front elevation view of a portion of a conveyor belt bucket subassembly potentially usefully employed as a penetration means in the practice of the invention.

FIG. 16 is a front elevation view of a portion of a penetration device 700 comprising an endless belt shovel assembly 702 comprising endless belt 706 mounted on rollers 709 and 711, which in turn are respectively mounted on rotating shaft 710 and 712 to effect rotation of the belt in a clockwise fashion. The belt 706 has mounted on the exterior surface thereof a series of spaced-apart shovel members 708, having suitable scoop or shovel shape so as to be operatively effective for penetration of a situs 715, such as a terrestrial or extraterrestrial ground or geological formation. In operation, the clockwise rotation of the belt 706 causes the shovel members 708 to engage the situs 715 and penetrate same. Removed material is discharged by the shovel members 708 during their travel, into collection receptacle 713. Collection receptacle 713 has a funicular lower portion communicating with collection conduit 714, through which the extracted material is withdrawn into the interior of housing 704 of the apparatus, for subsequent storage, sampling, analysis, or other processing therein.

Figure 17:
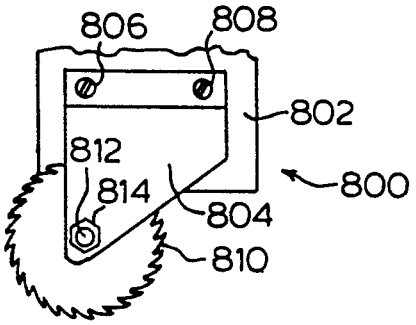
FIG. 17 is a front elevation view of a portion of a saw subassembly potentially usefully employed as a penetration means in the practice of the invention.

FIG. 17 is a front elevation view of a portion of another penetration device 800 which may be usefully employed in the broad practice of the present invention.

The device 800 includes a toothed saw blade 810 mounted for rotation on spindle 812 and connected to suitable drive means (not shown) to effect rotation of the saw blade. The spindle 812 is secured in position on extension flange 804, by means of nut fastener 814. The extension flange 804 in turn is secured to the housing 802 of the penetration/mass transfer assembly by means of mechanical fasteners 806 and 808.

The respective embodiments of FIGS. 13–17 just described are illustrative of the variety of penetration means which may be used in the broad practice of the present invention, to effectuate penetration of a penetrable situs, by corresponding unit operations such as drilling, piercing, lasing, digging, and/or sawing.

Figure 18:
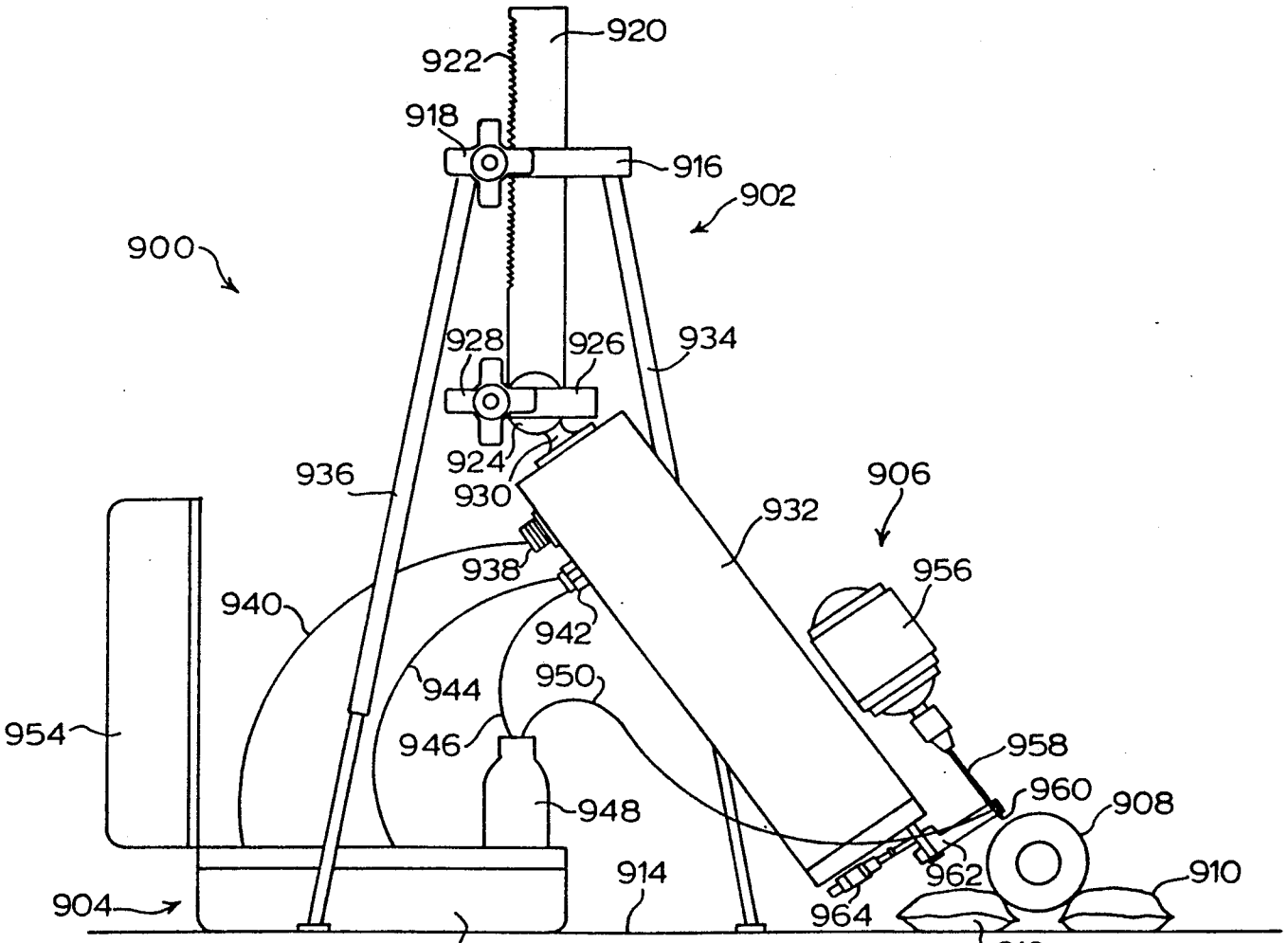
FIG. 18 is a front elevation view of a penetration/mass transfer apparatus according to another embodiment of the present invention.

FIG. 18 is a front elevation view of a penetration/injection apparatus according to another embodiment of the present invention.

As shown in FIG. 18, the penetration/injection apparatus 900 comprises a tripod support unit 902, a suitcase-type housing 904 (containing anaerobic sealant supply vessel 948, a gas supply means and associated pneumatic/gas supply elements, as well as electronic components and power supply means), and a drilling/injection module 906.

This system shown in FIG. 18 is remotely actuatable in a manner analogous to the embodiment shown and described with reference to FIGS. 6–9 herein, e.g., by a radio control signal from a wireless remote device such as a 1.5 volt DC signal output from an M122 wireless firing device. For such purpose, the housing 904 may contain suitable radio control signal-receiving circuitry, of a type similar to that shown and described with reference to FIG. 9 herein, which is responsive to the control signal to carry out the drilling and sealant injection functions of the apparatus.

The tripod support unit 902 of the apparatus comprises a main support base 916 which is joined to tripod legs 934 and 936 (in the view shown in FIG. 18, the third leg is directly behind leg 936, and thus is not visible, however, in appearance, structure, and function, it is identical to each of the other legs 934 and 936). Each of the tripod legs is telescopingly adjustable in a known, conventional fashion, with the adjacent successive segments of each leg being lockably securable to one another (by means, such as latches, not shown in FIG. 18), so as to permit the tripod support unit to be adjusted to a desired height and attitude in relation to the support surface 914 on which the tripod support unit is reposed.

Centrally mounted in the main support base 916 of the tripod support unit 902, in a central opening thereof (not shown in the view of FIG. 18), is a vertically translatable rack and pinion tube 920 having on an external surface portion thereof a rack gear 922. The rack gear is matingly engaged with a corresponding pinion gear (not shown) to which height adjustment knob 918 is coupled. By manual movement of the height adjustment knob 918, the pinion gear coupled therewith is motively engaged with the rack gear 922 to translate the tube upwardly or downwardly, as desired.

At its lower end, the rack and pinion tube 920 has joined thereto a ball joint clamp 926 with associated clamp screw 928 accommodating positioning therein of a ball element 924. The ball element 924 in turn is joined by a stem 930 to drilling/injection module 932. By this arrangement, the ball element can be selectively positioned in the ball joint clamp 926 followed by tightening of the clamp screw 928 to securely fix the drilling/injection module 932 in a selected attitude and elevation relative to the support surface 914, and the ordnance article 908 to be deactivated.

The drilling/injection module 932 may be constructed in a manner generally analogous to the modular drilling/injection apparatus 110 of FIGS. 6 and 7, but utilizing electrical components in place of certain pneumatic components employed in the embodiment of FIGS. 6 and 7, e.g., the drill 956, which in the embodiment of FIG. 18 is an electrical motor rated at 1750 rpm and 200 inch-pounds of torque.

Electrical power is transmitted to the drilling/injection module 932 by means of the electrical control cable 940 which is connected to suitable power supply means in the housing 904 bottom section 952 (the top section 954 providing a cover which is matingly engageable with the bottom section 952 to yield a unitary enclosure suitable for storage and transport of the system elements in the bottom section 952). At its opposite end, the electrical control cable 940 is joined to the drilling/injection module 932 by means of a multi-pin electrical connector 938, which may for example comprise a 16-pin Amphenol ® electrical connector.

In the embodiment shown in FIG. 18, electrical power is employed to operate the electric drill comprising motor 956 and drill element 958. Electrical power is also utilized in the FIG. 18 embodiment to operate various solenoid valves in connection with carrying out the drilling and injection steps. The bottom section 952 of the housing 904 contains power supply components, a compressed air supply (e.g., a 2 cubic feet high pressure gas cylinder, having a diameter of approximately 2 inches and a length of approximately 1 foot) for supplying compressed gas for the gas requirements of pneumatic components of the system, and programmable controller means for initiating and sequencing the operational steps carried out in the system.

The bottom section 952 of the housing 904 also contains the sealant reservoir 948 which holds the sealant material which ultimately is injected into the ordnance article 908 held in position by sandbags 910 and 912. The sealant material may be of any suitable type which cures in situ in the interior of the ordnance article 908 when flowed thereinto. The sealant material usefully is an anaerobic sealant medium, i.e., an initially flowable sealant material which cures to a solid final product in the substantial absence of oxygen. A useful anaerobic sealant material for such purpose is the aforementioned Loctite Product 17380.

It will be recognized that the sealant medium may be widely varied in the practice of the invention, and sealants such as two-part epoxy sealants, single package ambient temperature curable silicones, or other useful materials may be advantageously employed, however anaerobic sealants are highly preferred in practice due to their extremely rapid cure at ambient temperatures, to form an immobilizing (in respect of the ordnance actuation means) solid cured product.

The sealant reservoir 948 is a closed (hermetically sealed) vessel which is selectively pressurized by flow of gas into the reservoir from a pressurizing line 946 which is connected to the reservoir at a first end thereof, with its opposite end being secured to the drilling/injection module 932 by means of pneumatic fitting 942. The pneumatic fitting 942 also couples the drilling/injection module 932 with the compressed gas supply tank (not shown) in the bottom section 952 of housing 904, by means of gas feed supply line 944.

At the lower extremity of drilling/injection module 932 is mounted an injector arm 962 which is pivotally swingable about a pivot spindle as shown, the pivot spindle being generally parallelly aligned with the longitudinal axis of the drilling/injection module 932. The injector arm 962 is actuatingly coupled with the injector arm cylinder 964 which serves to selectively translate the injector arm 962 between a first retracted position in which the arm is "folded in" (out of the drill path of the drilling element 958) and a second extended position in which the injector nozzle 960 at the outer extremity of injector arm 962 is in alignment with the penetration opening drilled by drilling element 958.

The drilling element 958 has a drill tip at its distal extremity which may be for example be sheathed in a tungsten carbide or diamond coating to improve its hardness and cutting capability. The drill 956 is constructed and arranged to be reciprocatingly translatable along a drill path parallel to the longitudinal axis of the drilling/injection module 932, between a retracted position in which the drill tip is in spaced relationship to the outer surface of the ordnance article 908 held in position by sandbags 910 and 912, and an engaged drilling position.

The ordnance article 908 may be of any suitable type including an actuation mechanism which is de-actuatable by the drilling/sealant injection system of the present invention. For example, the ordnance article may be an article such as an artillery shell (e.g., a 105 millimeter artillery projectile), a rocket, a grenade, a bomb, etc.

In a preferred aspect, the injector nozzle 960 which is carried at the extremity of the injector arm 962 is a disposable nozzle element. This disposable nozzle element features a ⅛-inch pilot hole on its top surface with which the drill tip of drilling element 958 engages, after the nozzle element is translated into lateral alignment with the penetration opening in the ordnance article 908 (such penetration opening having been drilled by the drilling element while the injector arm 962 is in its retracted position).

The injector nozzle 960 is connected by means of sealant feed line 950 to the sealant reservoir 948, whereby sealant material is flowed from the reservoir to the nozzle and flowed into the penetration opening in the ordnance article 908.

In operation of the apparatus shown in FIG. 18, the ordnance article 908 is placed in a desired position with the sandbags 910 and 912 securing same. The drilling-/injection module 932 is moved into the desired attitude and proximity in relation to the ordnance article, by means of adjustment of the height adjustment knob 918 and clamp screw 928.

Once in position, the drilling/injection module 932 is connected to the electrical, pneumatic, and sealant supply means in the bottom section 952 of housing 904, by means of lines 940, 944, 946, and 950.

With the apparatus set up, the drilling and injection sequence is initiated by remote control. A radio control signal is sent by a remote control unit (not shown) such as the aforementioned M122 firing device. In response to such radio control signal, the microprocessor in the bottom section 952 of housing 904 controllingly actuates the electric motor 956 and initiates the rotation and translation of the drilling element 958.

The drilling element 958 then drills into the casing of the ordnance article 908, being downwardly translated to provide a penetration opening of a size and character allowing subsequent injection filling (of the interior volume of the ordnance article in communication with the penetration opening, e.g., in the portion of the interior volume of the ordnance article containing the actuation or trigger mechanism for the ordnance article).

After the penetration opening has been satisfactorily drilled, the drilling element is retracted, and the injector arm 962 is swung from its retracted position so that the nozzle element mounted on the arm is brought into alignment with the drilled opening in the ordnance article. The drilling element 958 then is again forwardly translated into contact with the upper surface of the nozzle element (as mentioned above, the nozzle element may have on its upper surface a "pilot hole" with which the tip of the drilling element is engaged in this step, so that the drilling element is "self-aligning" with respect to the nozzle element). Further downward translation of the drilling element urges the nozzle element into the previously drilled penetration opening. The drilling element during the injection operation maintains compressive bearing action on the nozzle, to ensure that the nozzle element is leak-tightly engaged with the penetration opening in the ordnance article.

Injection of sealant material then commences as the sealant reservoir 948 is pressurized with compressed gas derived from the aforementioned compressed gas cylinder (not shown) in bottom section 952 of housing 904, the compressed gas being flowed into the drilling/injection module 932 through line 944 and from the drilling-/injection module to the sealant reservoir 948 in line 942.

As a result, sealant material is flowed from the sealant reservoir 948 through line 950 to the injector nozzle element 960 maintained in bearing contact with the penetration opening in the ordnance article by the bearing action of drilling element 958. The sealant flows into the interior volume of the ordnance article and then cures in situ to immobilize and render inoperative the actuation means (e.g., firing mechanism) of the ordnance article.

Subsequent to such cure of the sealant medium taking place, or alternatively prior to or during such curing, the drilling element (with or without the nozzle element) may be retracted. When the nozzle element is a disposable element, as described hereinabove, the nozzle element may simply remain in place at the entrance of the penetration opening passage, and the arm 962 may be disengaged from the nozzle element.

It is an important aspect and major advance of the present invention that the drilling and injection of the ordnance article is able to be carried out in a remotely controlled fashion, so that persons such as ordnance technicians and/or demolition experts are not required to "inert" the ordnance in actual physical proximity to the ordnance article (as is the case with prior art means and methods), but instead may be a substantial and safe distance away, utilizing a remote controller unit to actuate the drilling and injection apparatus through suitable responsive control means in the housing 904.

The compact configuration of the housing 904, in the nature of a suitcase-type module, means that the entire apparatus, including the tripod support and the drilling-/injection module 932, is readily portable, and easily carried to the site of the article to be deactuated, which may be a military operations field site or other site where quick set-up and operation of the apparatus is required. These portability, remote control, and ease-of-use characteristics are also apposite to other embodiments of the invention, and the invention thereby achieve a substantial advance in the art of deactivating ordnance, incendiary devices, etc.

The mass transfer operation which is carried out in the practice of the present invention may be of widely varying type, involving injection into and/or extraction from the interior region of a penetrated situs, with respect to a material of interest. Thus, the mass transfer operation may include filling or injection with a solidifiable flowable sealant material, as in various illustrative embodiments discussed hereinabove. Alternatively, the injected material may be a tracer or monitoring composition, a sterilizing solution, gaseous treating composition, inhalable fluid, or any other suitable mass transfer substance. In the same respect, the mass transfer operation may include extraction of material from the penetrated situs, and such material may be of widely varying character, as associated with a specific penetrated situs, including fluids, liquids, solids, semi-solids, etc.

While the invention has been shown and described with respect to illustrative embodiments herein, it will be recognized that numerous variations, modifications, and other embodiments are possible, and accordingly, the invention is to be broadly construed as encompassing such other variations, modifications, and other embodiments, within the scope of the appended claims.

What is claimed is:

1. An apparatus for effecting penetration and mass transfer at a penetrable situs, comprising:

(a) a penetration member constructed and arranged for movement between (i) a first position disengaged from the penetrable situs, and (ii) a second position engaged with the penetrable situs to form a penetration opening in the penetrable situs communicating with an interior region thereof;

(b) a motive driver for selectively moving the penetration member between the first position and second position;

(c) a mass transfer assembly comprising a mass transfer passage member which is selectively engageable with the penetration opening in the penetrable situs, after formation thereof by the penetration member in the second position and subsequent movement of the penetration member by the motive driver to the first position, and wherein the mass transfer assembly is constructed and arranged to effect mass transfer through the penetration opening between the interior region of the penetrable situs and a locus exterior to the penetrable situs, when the mass transfer passage member is engaged with the penetration opening;

(d) means for actuating the motive driver and penetration member, to translate the penetration member from the first position to the second position, to form said penetration opening in the penetrable situs, and thereafter to translate the penetration member from the second position to the first position; and (e) means for (i) swingably translating the mass transfer passage member, from an inactive position during formation of said penetration opening, into alignment between said penetration opening and said penetrable member after said penetration member has been returned to the first position after formation of said penetration opening, and (ii) linearly translating the mass transfer passage member in said alignment, into engagement with the penetration opening.

2. An apparatus according to claim 1, wherein the penetration member comprises a member selected from the group consisting of: rotary drills; impact piercing elements; lasing devices, continuous belt shovels; and saws.

3. An apparatus according to claim 1, wherein the mass transfer assembly comprises an injector assembly including said mass transfer passage member, for injecting a flowable medium through the penetration opening into the interior region of the penetrable situs.

4. An apparatus according to claim 3, wherein the injector assembly includes: an injector carriage comprising a housing defining a flow passage therewithin; said mass transfer passage member comprising an injector nozzle mounted on the injector carriage housing and in flow communication with the flow passage therewithin; an inlet port in the injector carriage housing, coupleable with a supply container of the flowable medium; and motive drive means for selectively moving the injector carriage between (i) a first retracted position wherein the injector nozzle in said inactive position is non-engageable with the penetration opening of the penetrable situs, and (ii) a second engagement position wherein the injector nozzle in said alignment is oriented for translational engagement with the penetration opening of the penetrable situs.

5. An apparatus according to claim 4, wherein in its second engagement position, the oriented injector nozzle is coaxially aligned with the penetration member in its first retracted position, and the motive driver (b) is constructed and arranged to (I) forwardly translate the coaxially aligned nozzle and the retracted penetration member, as a unitary structure, toward the penetrable situs until the injector nozzle is brought into engagement with the penetration opening of the penetrable situs, and (II) rearwardly translate the coaxially aligned nozzle and the retracted penetration member, as a unitary structure, to a rearward position at which the injector nozzle is disengaged from the penetration opening of the penetrable situs.

6. An apparatus according to claim 1, wherein the reciprocatable penetration member, motive driver, and mass transfer assembly are mounted as a unitary, modular apparatus on a base support structure.

7. An apparatus according to claim 6, wherein the base support structure comprises: a base plate reposable on a support surface and having an upper main surface; a mounting bracket positionable on the base plate and having an opening therethrough; an elongate base column having first and second ends, with the first end being of enlarged size relative to the remaining structure of the elongate base column, and with the first end being of sufficient size to be reposable in the mounting bracket opening, such that the elongate base column extends upwardly to its second end and is selectively pivotally moveable about the first end when the first end is reposed in the mounting bracket opening; and a clamping assembly for securing the mounting bracket to the base plate and for selectively securing the elongate base column in a predetermined upwardly extending orientation in relation to the base plate.

8. An apparatus according to claim 7, wherein the penetration member, motive driver, and mass transfer assembly are structurally consolidated as a unitary penetration/mass transfer module which is selectively engageable with the elongate base column for mounting of the penetration/mass transfer module on the base support.

9. An apparatus according to claim 8, wherein the mass transfer assembly comprises an injector, for delivering a predetermined material to the interior region of the penetrable situs.

10. An apparatus according to claim 1, wherein the mass transfer assembly comprises an extractor, for withdrawing a material from the interior region of the penetrable situs.

11. An apparatus according to claim 1, wherein the motive driver comprises electric drive means, and an electric power source therefor.

12. An apparatus according to claim 1, wherein the motive driver comprises hydraulic drive means, and a hydraulic power source therefor.

13. An apparatus according to claim 6, wherein the base support structure comprises a motively driven carriage which is remotely actuatable, and has the penetration member and the mass transfer assembly coupled thereto, such that when remotely actuated, the carriage translates the penetration member and mass transfer assembly from a remote location into penetration and mass transfer proximity to the penetrable situs.

14. An apparatus for effecting penetration and mass transfer at a penetrable situs, comprising:

(a) a support assembly comprising a selectively vertically translatable member having joined thereto a selectively rotationally positionable mounting element, for varying the elevation and angular orientation of a structural assembly secured to said mounting element;

(b) a reciprocatable penetration member secured to the mounting element of said support assembly and arranged for reciprocatable movement between (i) a first retracted position disengaged from the penetrable situs, and (ii) a second extended position engaged with the penetrable situs to form a penetration opening in the penetrable situs communicating with an interior region thereof;

(c) a motive driver for selectively moving the reciprocatable penetration member between the first retracted position and second engaged position;

(d) a mass transfer assembly comprising a mass transfer passage member which is selectively engageable with the penetration opening in the penetrable situs, after formation thereof by the penetration member in the second extended position and subsequent movement of the penetration member by the motive driver to the first retracted position, and wherein the mass transfer assembly is constructed and arranged to effect mass transfer through the penetration opening between the interior region of the penetrable situs and a locus exterior to the penetrable situs, when the mass transfer passage member is engaged with the penetration opening;

(e) means for actuating the motive driver and penetration member, to translate the penetration member from the first position to the second position, to form said penetration opening in the penetrable situs, and thereafter to translate the penetration member from the second position to the first position; and (f) means for (i) swingably translating the mass transfer passage member, from an inactive position during formation of said penetration opening, into alignment between said penetration opening and said penetrable member after said penetration member has been returned to the first position after formation of said penetration opening, and (ii) linearly translating the mass transfer passage member in said alignment, into engagement with the penetration opening.

15. An apparatus according to claim 14, wherein the penetration member, motive driver, and mass transfer assembly are electro-pneumatically operated and controlled in their respective penetration, driving, and mass transfer functions.

16. An apparatus according to claim 14, wherein the motive driver comprises a pneumatic advancing/retracting cylinder operatively coupled to a carriage member for selective advancement and retraction of the carriage member, and wherein the penetration member and the mass transfer assembly are mounted on the carriage member for translational movement thereon with the selective advancement and retraction of the carriage member.

17. An apparatus according to claim 16, wherein the pneumatic advancing/retracting cylinder is coupled with a hydraulic checking cylinder constructed and arranged to reduce jerkiness in movements of the carriage member in selective advancement and retraction thereof by the pneumatic advancing/retracting cylinder.

18. An apparatus according to claim 1, wherein penetration, driving, and mass transfer functions of the respective penetration member, motive driver, and mass transfer assembly are programmatically controlled by a control system comprising a programmable controller.

19. An apparatus according to claim 18, wherein the control system comprising the programmable controller includes an electrical actuator circuit for the programmable controller, wherein the electrical actuator circuit is remotely controllable in signal receiving relationship to a remote control signal generator to initiate operation of the programmable controller.

20. An apparatus for deactivating an ordnance article including an actuation mechanism disposed in an interior volume of a casing, said apparatus comprising:

(a) a base support structure;

(b) a drilling and injection module mounted on said base support structure, said drilling and injection module comprising:

(I) a drilling element;

(II) means for selectively controllably (i) rotating the drilling element, (ii) translating the drilling element from a retracted position in proximity to the ordnance article, into engagement with the ordnance article to effect drilling through the casing into the interior volume thereof, to provide a penetration opening through the casing, and (iii) subsequent to said drilling withdrawing the drilling element from the penetration opening;

(III) a sealant injector arm including an injector nozzle thereon;

(IV) means for translating the sealant injector arm from a retracted position permitting drilling by the drilling element, to a position engaging the injector nozzle with the penetration opening;

(c) mounting means allowing the drilling and injection module to be selectively positioned at a selected attitude and height in relation to the ordnance article;

(d) means for selectively supplying a pressurized flowable sealant medium to the injector nozzle for flow therethrough;

(e) a controller module remotely actuatable by a remote control signal, and controllingly effective to sequentially actuate said means (b)(II), (b)(IV), and (d), to thereby sequentially carry out the operational steps of:

(i) rotating the drilling element, (ii) translating the drilling element from a retracted position in proximity to the ordnance article, into engagement with the ordnance article to effect drilling through the casing into the interior volume thereof, to provide a penetration opening through the casing, and (iii) subsequent to said drilling withdrawing the drilling element from the penetration opening;

translating the sealant injector arm from a retracted position permitting drilling by the drilling element, to a position engaging the injector nozzle with the penetration opening; and supplying a pressurized flowable sealant medium to the injector nozzle for flow therethrough; and (f) a remote control unit for generating a remote control signal actuatingly effective for the controller module (e), at a locus remote therefrom.

21. A method of effecting penetration and mass transfer at a penetrable situs, comprising:

providing an apparatus including:

(a) a penetration member constructed and arranged for movement between (i) a first position disengaged from the penetrable situs, and (ii) a second position engaged with the penetrable situs to form a penetration opening in the penetrable situs communicating with an interior region thereof;

(b) a motive driver for selectively moving the penetration member between the first position and second position;

(c) a mass transfer assembly comprising a mass transfer passage member which is selectively engageable with the penetration opening in the penetrable situs, after formation thereof by the penetration member in the second position and subsequent movement of the penetration member by the motive driver to the first position, and wherein the mass transfer assembly is constructed and arranged to effect mass transfer through the penetration opening between the interior region of the penetrable situs and a locus exterior to the penetrable situs, when the mass transfer passage member is engaged with the penetration opening;

(d) means for actuating the motive driver and penetration member, to translate the penetration member from the first position to the second position, to form said penetration opening in the penetrable situs, and thereafter to translate the penetration member from the second position to the first position; and (c) means for (i) swingably translating the mass transfer passage member, from an inactive position during formation of said penetration opening into alignment between said penetration opening and said penetration member after said penetration member has been returned to the first position after formation of said penetration opening, and (ii) linearly translating the mass transfer passage member in said alignment, into engagement with the penetration opening;

actuating the motive driver via means (d) to translate the penetration member from said first position to said second position to form a penetration opening in the penetrable situs, and thereafter translating the penetration member from the second position to the first position;

actuating means (e), to engage the mass transfer passage member with the penetration opening; and effecting mass transfer through the penetration opening and said mass transfer passage member, between an interior region of the situs and a locus exterior to the situs.

22. An apparatus for effecting mass transfer at a penetrable situs, said apparatus comprising:

(a) a base support structure;

(b) a drilling and mass transfer module mounted on said base support structure, said drilling and mass transfer module comprising:

(I) a drilling element;

(II) means for selectively controllably (i) rotating the drilling element, (ii) translating the drilling element from a retracted position in proximity to the situs, into engagement with the situs to effect drilling into the situs to an interior volume thereof, to provide a penetration opening at the situs, and (iii) subsequent to said drilling withdrawing the drilling element from the penetration opening;

(III) a mass transfer arm including a mass transfer passage thereon;

(IV) means for translating the mass transfer arm from a retracted position permitting drilling by the drilling element, to a position engaging the mass transfer passage with the penetration opening;

(c) mounting means allowing the drilling and mass transfer module to be selectively positioned at a selected attitude and height in relation to the situs;

(d) means for effecting mass transfer interchange with the situs through the mass transfer passage;

(e) a controller module remotely actuatable by a remote control signal, and controllingly effective to sequentially actuate said means (b) (II), (b)(IV), and (d), to thereby sequentially carry out the operational steps of:

(i) rotating the drilling element, (ii) translating the drilling element from a retracted position in proximity to the situs, into engagement with the situs to effect drilling into the situs to an interior volume thereof, to provide a penetration opening at the situs, and (iii) subsequent to said drilling withdrawing the drilling element from the penetration opening;

translating the mass transfer arm from a retracted position permitting drilling by the drilling element, to a position engaging the mass transfer passage with the penetration opening; and effecting mass transfer interchange with the situs through the mass transfer passage; and (f) a remote control unit for generating a remote control signal actuatingly effective for the controller module (e), at a locus remote therefrom.

23. An apparatus according to claim 1, wherein the penetration member is arranged to compressively bear against the mass transfer passage member as it is linearly translated into engagement with the penetration opening.

24. An apparatus according to claim 14, wherein the selectively vertically translatable member comprises a vertically translatable rack and pinion tube having on an external surface portion thereof a rack gear, with a pinion gear on the support assembly engageable with the rack gear for selective adjustment of the height of the rack and pinion tube, and a ball joint fixture mounted on said rack and pinion tube, a stem-bearing ball element reposed in said ball joint fixture, and the stem of said stem-bearing ball element comprising said mounting element having coupled thereto a penetration and mass transfer module comprising apparatus components (b)-(f).

* * * * *